US011592854B2

(12) United States Patent
Shreepathi Bhat

(10) Patent No.: US 11,592,854 B2
(45) Date of Patent: Feb. 28, 2023

(54) LINEAR VOLTAGE REGULATOR

(71) Applicant: TEXAS INSTRUMENTS INCORPORATED, Dallas, TX (US)

(72) Inventor: Avinash Shreepathi Bhat, Tucson, AZ (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 17/364,259

(22) Filed: Jun. 30, 2021

(65) Prior Publication Data

US 2022/0137654 A1 May 5, 2022

Related U.S. Application Data

(60) Provisional application No. 63/107,590, filed on Oct. 30, 2020.

(51) Int. Cl.
*G05F 1/565* (2006.01)

(52) U.S. Cl.
CPC ..... *G05F 1/565* (2013.01)

(58) Field of Classification Search
CPC ..... G05F 1/565
See application file for complete search history.

(56) References Cited

U.S. PATENT DOCUMENTS

| | | | |
|---|---|---|---|
| 7,872,454 | B2 | 1/2011 | Sutardja |
| 8,427,122 | B2 | 4/2013 | Dasgupta |
| 9,577,508 | B2 | 2/2017 | Wang |
| 9,665,112 | B2 | 5/2017 | Singh et al. |
| 10,291,125 | B2 | 5/2019 | Raval et al. |
| 10,571,945 | B2 | 2/2020 | Pishdad |
| 2009/0079406 | A1* | 3/2009 | Deng ..... G05F 1/565 323/280 |

(Continued)

FOREIGN PATENT DOCUMENTS

| | | | |
|---|---|---|---|
| CN | 101853040 | A | 10/2010 |
| CN | 109062309 | A | 12/2018 |
| CN | 111176358 | A | 5/2020 |

OTHER PUBLICATIONS

Search Report for PCT Patent Application No. PCT/US2021/057492 date of mailing of the international search report dated Jan. 27, 2022, 1 page.

*Primary Examiner* — Kyle J Moody
*Assistant Examiner* — Lakaisha Jackson
(74) *Attorney, Agent, or Firm* — Charles F. Koch.; Frank D. Cimino

(57) ABSTRACT

A linear voltage regulator includes a voltage input and a voltage output. The linear voltage regulator includes a buffer having a voltage node, an input node, an output node and a control node and a power transistor having a control node coupled to the output node of the buffer, an input node coupled to the voltage input and an output node coupled to the voltage output. The linear voltage regulator includes a dropout detection module having a control node coupled to the control node of the power transistor, a voltage input node coupled to the voltage input, a voltage output node coupled to the voltage output and an output node. The linear voltage regulator includes a feedforward module having an input node coupled to the output node of the dropout detection module and an output node coupled to the control node of the buffer.

17 Claims, 9 Drawing Sheets

(56) References Cited

U.S. PATENT DOCUMENTS

| | | | | |
|---|---|---|---|---|
| 2012/0293217 | A1 | 11/2012 | Ginsburg et al. | |
| 2017/0371365 | A1* | 12/2017 | Kossel | G05F 1/46 |
| 2018/0017982 | A1 | 1/2018 | Song et al. | |
| 2021/0124383 | A1* | 4/2021 | Iguchi | G05F 1/565 |
| 2022/0187862 | A1* | 6/2022 | Onódy | G05F 1/59 |

* cited by examiner

LINEAR VOLTAGE REGULATOR

CROSS-REFERENCE TO RELATED APPLICATION

This application claims the benefit of priority to U.S. Provisional Application No. 63/107,590, filed on 30 Oct. 2020, the entirety of which is herein incorporated by reference.

TECHNICAL FIELD

This relates generally to electronic circuitry, and more particularly to a circuit for a linear voltage regulator.

BACKGROUND

A linear voltage regulator is a system designed to automatically maintain a relatively constant output voltage level, even in situations where an input voltage level includes frequency spurs, voltage flickers, etc. (e.g., noise). A linear voltage regulator may use a simple feedforward design or may include negative feedback. A linear voltage regulator may be used to regulate one or more alternating current (AC) or direct current (DC) voltages. Linear voltage regulators are found in devices such as computer power supplies where the voltage regulators stabilize the DC voltages used by the processor and other elements.

A low-dropout regulator (LDO regulator) is a DC linear voltage regulator that regulates the output voltage even when the supply voltage is very close to the output voltage. LDO regulators have no switching noise on the output voltage and have a relatively simple design that includes a reference voltage, an amplifier, and a pass element.

SUMMARY

In a first example, a linear voltage regulator includes a voltage input and a voltage output. The linear voltage regulator also includes a buffer having a voltage node, an input node, an output node and a control node and a power transistor having a control node coupled to the output node of the buffer, an input node coupled to the voltage input and an output node coupled to the voltage output. The linear voltage regulator further includes a dropout detection module having a control node coupled to the control node of the power transistor, a voltage input node coupled to the voltage input, a voltage output node coupled to the voltage output and an output node. The linear voltage regulator still further includes a feedforward module having an input node coupled to the output node of the dropout detection module and an output node coupled to the control node of the buffer.

In a second example, a linear voltage regulator includes a buffer configured to output a buffer voltage signal. The linear voltage regulator also includes a power transistor configured to receive the buffer voltage signal and provide an output voltage at an output node configured to be coupled to a load, in which the output voltage is based on an input voltage and the buffer voltage signal. The linear voltage regulator further includes a dropout detection module configured to assert a power supply rejection ratio signal if a voltage difference between a voltage level of the input voltage and a voltage level of the output voltage is less than a threshold and the power supply rejection ratio signal is de-asserted if the voltage difference between the voltage level of the voltage input and the voltage level at the voltage output is greater than or equal to the threshold voltage. The linear voltage regulator still further includes a feedforward circuit module configured to assert a noise rejection signal in response to assertion of the power supply rejection ratio signal and de-assert the noise rejection signal in response to de-assertion of the power supply rejection ratio signal, in which the buffer injects noise in the buffer voltage signal in response to assertion of the noise rejection signal and the power transistor filters noise in the input voltage in response to injection of noise in the buffer voltage signal.

In a third example, a system includes a linear voltage regulator. The linear voltage regulator includes a buffer configured to output a buffer voltage signal and a power transistor configured to receive the buffer voltage signal and provide an output voltage on an output node of the linear voltage regulator, in which the output voltage is based on an input voltage and the buffer voltage signal. The linear voltage regulator also includes a dropout detection module configured to assert a power supply rejection ratio signal if a voltage difference between a voltage level of the voltage input and a voltage level at the voltage output is less than a threshold voltage and the power supply rejection ratio signal is de-asserted if the voltage difference between the voltage level of the voltage input and the voltage level at the voltage output is greater than or equal to the threshold voltage. The linear voltage regulator still further includes a feedforward circuit module configured to assert a noise rejection signal in response to assertion of the power supply rejection ratio signal and de-assert the noise rejection signal in response to de-assertion of the power supply rejection ratio signal, in which the buffer and the power transistor are configured to filter noise from the input voltage in response to assertion of the noise rejection signal. The system includes a load coupled to an output node of the linear voltage regulator, in which a current provided to the load varies as a function of time and a voltage provided to the load from the linear voltage regulator remains about constant.

DETAILED DESCRIPTION

Figure 1:
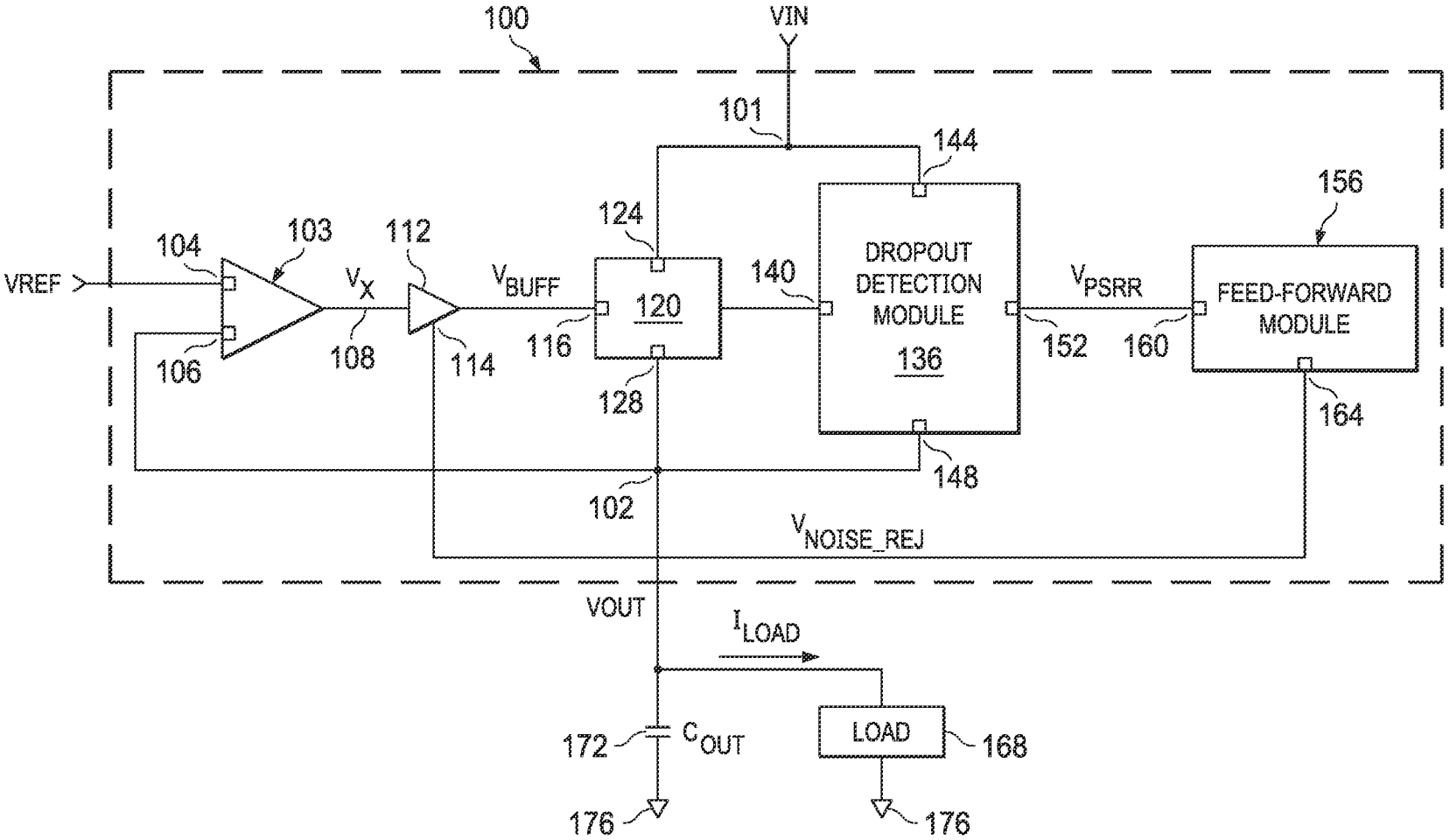
FIG. 1 is a block diagram of an example a linear voltage regulator.

A linear voltage regulator (alternatively referred to as a linear regulator) is a circuit used to provide a regulated output voltage at a voltage output from a varying/noisy input voltage provided at a voltage input. A power supply rejection ratio (PSRR) of a linear voltage regulator defines how well supply noise is rejected at the output voltage of the linear voltage regulator. In this description, the linear voltage regulator uses a feedforward technique to selectively inject a fraction of the supply voltage into a buffer, or more generally, a driver, within the linear voltage regulator while tracking a load current to cancel supply noise at the output, thereby improving the PSRR of the linear voltage regulator during time intervals where the difference between the input voltage and the output voltage is small (e.g., less than a threshold voltage). Conversely, during time intervals where the difference between the input voltage and the output voltage is greater than or equal to the threshold voltage, the feedforward technique is disabled to maintain power efficiency of the linear voltage regulator.

More specifically, a linear voltage regulator includes a buffer that outputs a buffer voltage signal, $V_{BUFF}$ at an output. The linear voltage regulator also includes a power transistor coupled to the output of the buffer. In this description, the term "couple" or 'couples" means either an indirect or direct connection. The power transistor provides an output voltage, VOUT based on the buffer voltage and an input voltage, VIN. The linear voltage regulator includes a dropout detection module that assert a PSRR signal if a voltage difference between a voltage level of the voltage input and a voltage level at the voltage output is less than a threshold voltage, $V_{THRESH}$. Also, the dropout detection module de-asserts the PSRR signal if the voltage difference between the voltage level of the voltage input and the voltage level at the voltage output is greater than or equal to the threshold voltage, $V_{THRESH}$. The linear voltage regulator further includes a feedforward circuit module that asserts a noise rejection signal, $V_{NOISE_REJ}$ in response to assertion of the PSRR signal and de-asserts the noise rejection signal, $V_{NOISE_REJ}$ in response to de-assertion of the PSRR signal.

The noise rejection signal, $V_{NOISE_REJ}$ is injected into a control node of the buffer. Moreover the noise rejection signal, $V_{NOISE_REJ}$ includes a noise component of the input voltage, VIN, namely, $V_{IN_AC}$. In response to the noise rejection signal, $V_{NOISE_REJ}$, the buffer injects noise into the buffer voltage signal, $V_{BUFF}$. In response to injection of the noise in the buffer voltage signal, $V_{BUFF}$, the power transistor filters (cancels) noise in the input voltage, $V_{IN_AC}$, such that the output voltage, VOUT about constant. Unless otherwise stated, in this description, 'about' or 'approximately' preceding a value means+/−10 percent of the stated value.

FIG. 1 is a block diagram of a linear voltage regulator 100. The linear voltage regulator 100 implements a power supply, such as a low dropout regulator (LDO). Accordingly, the linear voltage regulator 100 receives an input voltage, VIN at a voltage input 101, a reference voltage, VREF and provides an output voltage, VOUT (a voltage output 102. The reference voltage, VREF is a bandgap voltage reference that is constant over power supply variations, temperature changes, or circuit loading from the linear voltage regulator 100. The linear voltage regulator 100 is configured such that the output voltage, VOUT remains constant in situations where the input voltage, VIN experiences noise, such as frequency spurs, voltage flickers, etc. The linear voltage regulator 100 has a power supply rejection ratio (PSRR) that characterizes the capability of the linear voltage regulator 100 to suppress any power supply variations to present on the input voltage, VIN from the output voltage, VOUT. Conventional methods to increase the PSRR of voltage regulator circuits include decreasing a power efficiency of the regulator to increase an available headroom. Instead of such conventional techniques, the linear voltage regulator 100 selectively asserts a noise rejection signal, $V_{NOISE_REJ}$ to cancel noise present in the input voltage, VIN.

The linear voltage regulator 100 includes an op-amp 103 (operational amplifier) with a first input node 104 that is coupled to the reference voltage, VREF and a second input node 106. In various examples, the first input node of the op-amp 103 is a given one of a non-inverting input or an inverting input for the op-amp 103, and the second input node 106 is the other of the non-inverting input or the inverting input of the op-amp 103. An output node of the op-amp 103 provides a voltage signal, Vx that is provided to an input node 108 of a buffer 112.

An output of the buffer 112, provides an output signal, $V_{BUFF}$ that is coupled to a control node 116 of a power transistor 120. The buffer 112, includes a control node 114 that is used to control the output signal, $V_{BUFF}$ provided to the control node 116 of the power transistor 120. In some examples, the power transistor 120 is implemented as a field effect transistor (FET), such as an n-channel FET (NFET) or a p-channel FET (PFET). In other examples, the power transistor 120 is implemented as a bipolar junction transistor (BJT), such as an NPN BJT or a PNP BJT. In examples where the power transistor 120 is implemented as a FET (NFET or PFET), the control node 116 of the power transistor 120 is a gate. In examples where the power transistor 120 is implemented as a BJT (NPN or PNP), the control node 116 is a base. The power transistor 120 also includes an input node 124 coupled to the input voltage, VIN at the voltage input 101 and an output node 128 that provides the output voltage, VOUT at the voltage output 102 of the linear voltage regulator 100 that is also coupled to the second input node 106 of the op-amp 103. In examples where the power transistor 120 is implemented as an NFET, the input node 124 represents a drain and the output node 128 represents a source. In examples where the power transistor 120 is implemented as a PFET, the input node 124 represents a source and the output node 128 represents a drain. In examples where the power transistor 120 is implemented as an NPN BJT, the input node 124 represents a collector and the output node 128 represents an emitter. In examples where the power transistor 120 is implemented with a PNP BJT, the input node 124 represents an emitter and the output node 128 represents a collector.

In some examples, a supplemental voltage, separate from the input voltage, VIN is provided. In other examples, the linear voltage regulator 100 operates with a single voltage source, such that the input voltage, VIN provides power to the components of the linear voltage regulator 100. The buffer voltage, $V_{BUFF}$ is also provided to a dropout detection module 136 at a control node 140 of the dropout detection module 136. A voltage input node 144 of the dropout detection module 136 is coupled to the input voltage, VIN at the voltage input 101 and a voltage output node 148 is coupled to the voltage output 102 of the linear voltage regulator 100. An output node 152 of the dropout detection module 136 provides a PSRR signal, $V_{PSRR}$ to a feedforward module 156 at an input node 160. The feedforward module 156 includes an output node 164 that provides a noise rejection signal, $V_{NOISE_REJ}$ to a control node 114 of the buffer 112.

The voltage output 102 is coupled to a load 168 coupled in parallel with an output capacitor 172. The load 168 and the output capacitor 172 are coupled to an electrically neutral node 176 (e.g., ground or virtual ground). A load current, $I_{LOAD}$ is provided to the load 168 from the voltage output 102. The load current, $I_{LOAD}$ varies as a function of time and a voltage provided to the load 168 from the linear voltage regulator 100 remains about constant.

In operation, the buffer 112 outputs the buffer voltage signal, $V_{BUFF}$ in response to the voltage signal Vx output by the op-amp 103. In response to the buffer voltage signal, $V_{BUFF}$, the power transistor 120 provides the output voltage, VOUT to the load 168 that varies as a function of the buffer voltage signal, $V_{BUFF}$. The linear voltage regulator 100 is configured such that if the output voltage, VOUT rises too high relative to the reference voltage, VREF, the buffer voltage signal, $V_{BUFF}$ is adjusted to control the power transistor 120 to maintain a constant output voltage, VOUT.

In situations where a difference between the input voltage and the output voltage (VIN-VOUT) is greater than or equal to a threshold voltage, $V_{THRESH}$, the power transistor 120 operates in the saturation region, such that noise injected into the input voltage, VIN is filtered by the buffer 112 and the op-amp 103. The noise injected into the input voltage, VIN is represented as $V_{IN_AC}$. Noise at the output voltage, VOUT is represented as VOUT_AC. If the power transistor 120 operates in the saturation region, then VOUT_AC is at least one order of magnitude (1/10) less than $V_{IN_AC}$. For instance, if the threshold voltage, $V_{THRESH}$ is equal to 1 V, and the voltage, VOUT is at least 1 V less than the input voltage, VIN the power transistor 120 operates in the saturation region and noise present in the input voltage, $V_{IN_AC}$ is filtered with a combination of the op-amp 103, the buffer 112 and the power transistor 120.

However, in situations where VOUT-VIN approaches the threshold voltage, $V_{THRESH}$, the power transistor 120 transitions from operating in the saturation region to the linear region, such as in response to an increase in the load current, $I_{LOAD}$. Accordingly, the dropout detection module 136 is configured with a delta voltage, ΔV that is experimentally determined and is less than the threshold voltage, $V_{THRESH}$ (e.g., $\Delta V<V_{THRESH}$). The dropout detection module 136 senses the buffer voltage signal, $V_{BUFF}$ and asserts the PSRR signal, $V_{PSRR}$ if a voltage difference between a voltage level of the voltage input node 144, VIN and a voltage level at the voltage output, VOUT is less than the threshold voltage, $V_{THRESH}$. Stated differently, the dropout detection module 136 asserts the PSRR signal, $V_{PSRR}$ if VOUT-VIN$<V_{THRESH}$. Further, the dropout detection module 136 de-asserts the PSRR signal, $V_{PSRR}$ if the voltage difference between the voltage level of the voltage input voltage, VIN and the voltage level at the voltage output, VOUT is greater than or equal to the threshold voltage, $V_{THRESH}$.

In response to assertion of the PSRR signal, $V_{PSRR}$, the feedforward module 156 asserts a noise rejection signal, $V_{NOISE_REJ}$ (alternatively referred to as a feed forward signal) that is injected into the control node 114 of the buffer 112. Conversely, in response to de-assertion of the PSRR signal, $V_{PSRR}$, the feedforward module 156 de-asserts the noise rejection signal, $V_{NOISE_REJ}$. In this manner, the dropout detection module 136 and the feedforward module 156 operate in concert to selectively apply a PSRR boost to the linear voltage regulator 100.

Responsive to injection of the noise rejection signal, $V_{NOISE_REJ}$, the buffer 112 is configured to inject noise in the buffer output, $V_{BUFF}$. The noise in the buffer output, $V_{BUFF}$ has an inverted polarity relative to the noise on the input voltage, $V_{IN_AC}$. Accordingly, responsive to the noise in the buffer output, $V_{BUFF}$, the power transistor 120 cancels the noise in the input voltage, $V_{IN_AC}$, such that the noise on the output voltage, VOUT_AC is curtailed.

Accordingly, the dropout detection module 136 selectively activates the feedforward module 156 during time intervals where the voltage difference between the input voltage, VIN and the voltage output, VOUT is less than the threshold voltage, $V_{THRESH}$ (e.g., during time intervals where VOUT-VIN$<V_{THRESH}$). Similarly, the feedforward module 156 is deactivated during time intervals where the voltage difference between the input voltage, VIN and the voltage output, VOUT is greater or equal to the threshold voltage $V_{THRESH}$ (e.g., during time intervals where VOUT-VIN $V_{THRESH}$). In this manner, the dropout voltage of the linear voltage regulator 100 and/or a size of the power transistor 120 is reducible without a reduction in power efficiency of the linear voltage regulator 100, in contrast to conventional techniques for lowering the dropout voltage.

Figure 2:
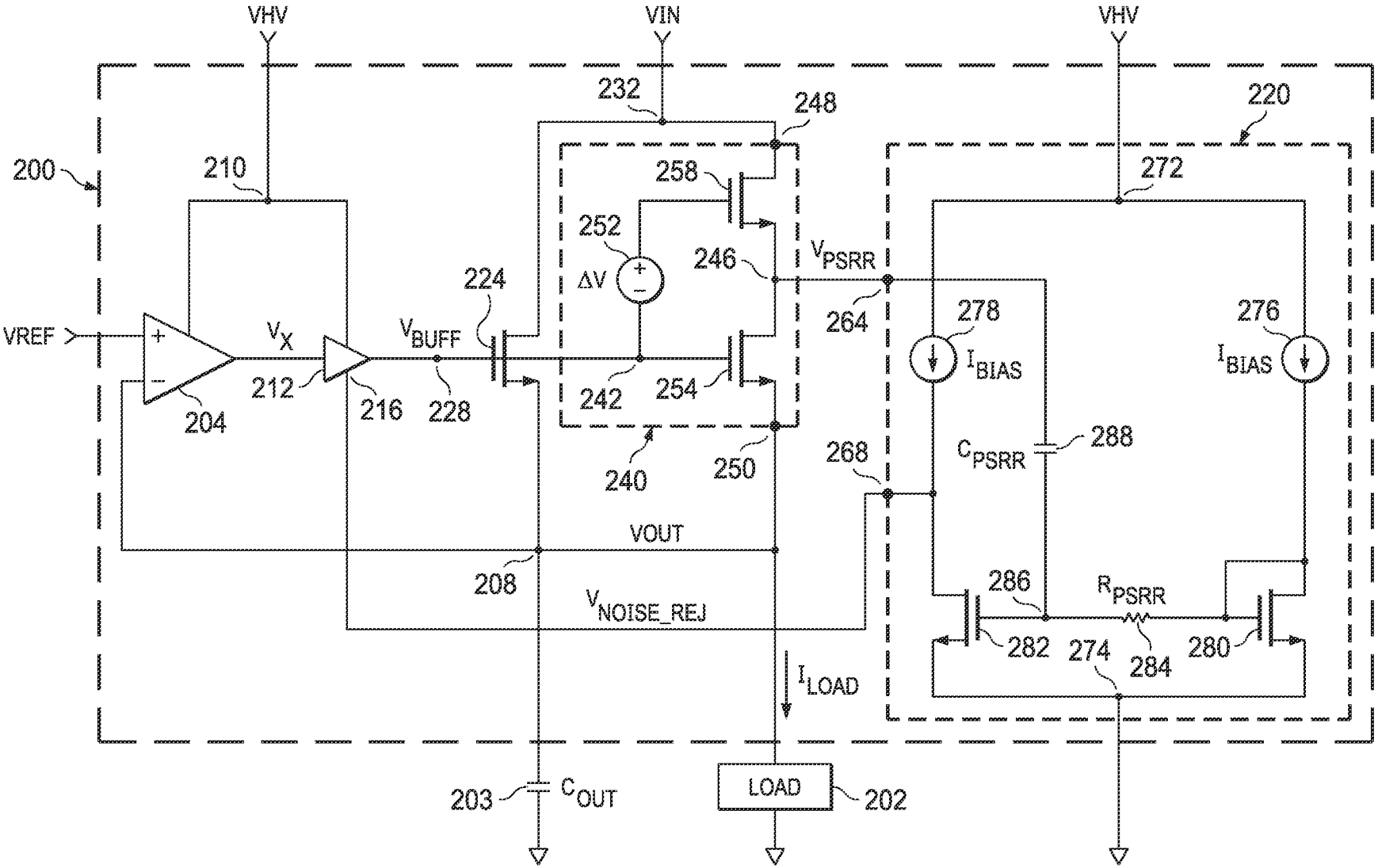
FIG. 2 is a circuit diagram of an example of a linear voltage regulator.

FIG. 2 illustrates a circuit diagram of a linear voltage regulator 200 that is employable to implement the linear voltage regulator 100 of FIG. 1. The linear voltage regulator 200 implements a linear voltage regulator, such as an LDO. Accordingly, the linear voltage regulator 200 receives a input voltage, VIN, a reference voltage, VREF and outputs an output voltage, VOUT to a load 202 and to an output capacitor 203 ($C_{OUT}$) that is in parallel with the load 202. As one example, the output capacitor 203 has a capacitance of about 10 microfarads (μF). The output voltage, VOUT induces a load current, $I_{LOAD}$ at the load 202. The linear voltage regulator 200 is configured such that the load current, $I_{LOAD}$ varies as a function of time, and that the output voltage, VOUT remains about constant in situations where the input voltage, VIN experiences noise, such as frequency spurs, voltage flickers, etc. The linear voltage regulator 200 also receives a supplemental voltage source, VHV that provides power to components of the linear voltage regulator 200.

The linear voltage regulator 200 has a power supply rejection ratio (PSRR) that characterizes the capability of the linear voltage regulator 200 to suppress power supply variations present in the input voltage, VIN from the output voltage, VOUT. The linear voltage regulator 200 includes an op-amp 204, and the reference voltage, VREF is provided to a non-inverting input of the op-amp 204. An inverting input of the op-amp 204 is coupled to a voltage output 208 of the linear voltage regulator 200, in which the voltage output 208 of the linear voltage regulator 200 provides the output voltage, VOUT. Also, an output of the op-amp 204, Vx is provided to an input of a buffer 212. The buffer 212 and the op-amp 204 have a power supply node coupled to a node 210 that is coupled to the supplemental voltage source, VHV. Also, the buffer 212 includes a control node 216 that receives a noise rejection signal, $V_{NOISE_REJ}$ from a feedforward module 220. The buffer 212 provides an output voltage, $V_{BUFF}$ to a power transistor 224.

Figure 3:
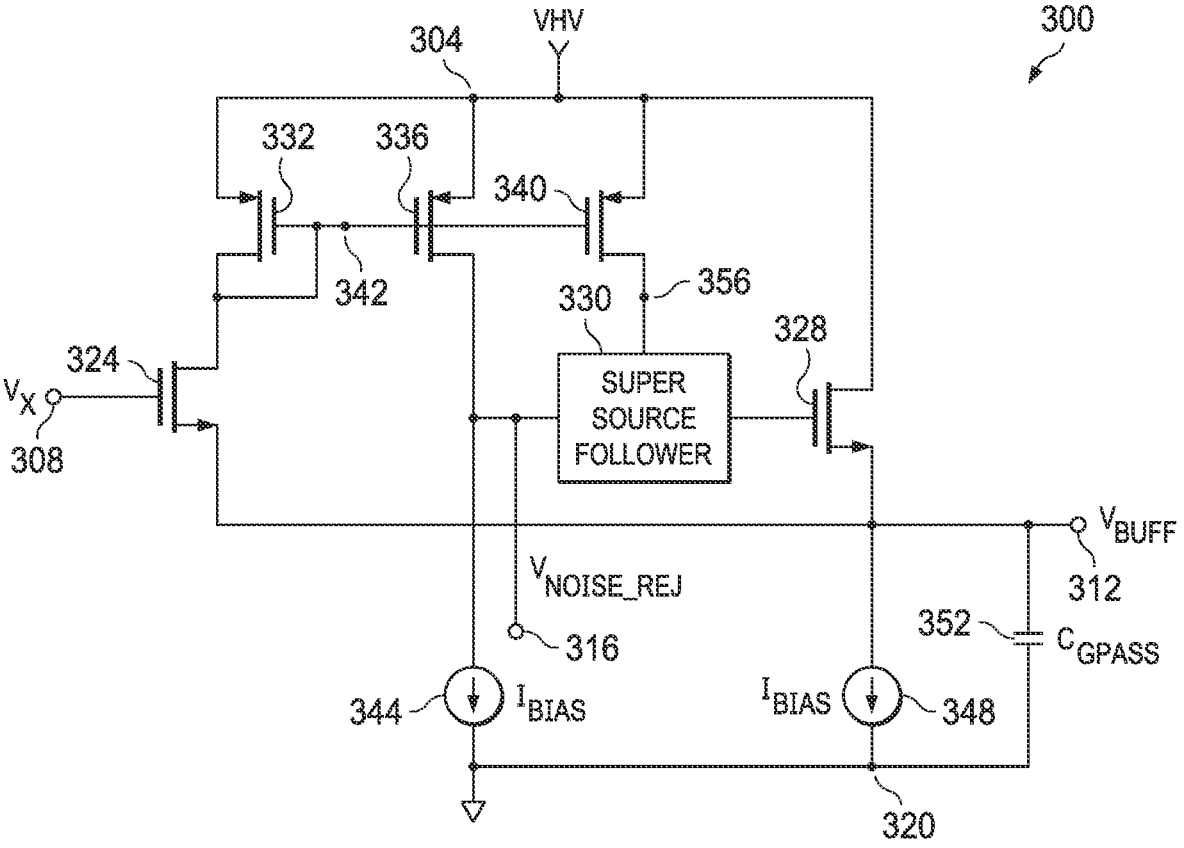
FIG. 3 is a circuit diagram of a buffer for the linear voltage regulator of FIG. 2.

FIG. 3 illustrates a circuit diagram for a buffer 300 for a linear voltage regulator, such as the linear voltage regulator 200 of FIG. 2. The buffer 300 is employable to implement the buffer 212 of FIG. 2. Thus, the same reference numbers and nomenclature is employed in FIGS. 2 and 3 to denote the same structure and signals. The buffer 300 includes a positive power supply node 304 that is coupled to the supplemental voltage source, VHV. The buffer 300 includes an input node 308 that receives a voltage, Vx output from an op-amp, such as the op-amp 204 of FIG. 1 and an output node 312 that provides an output signal for the buffer 300, $V_{BUFF}$. The buffer 300 also includes a control node 316 that receives the noise rejection signal, $V_{NOISE_REJ}$ from the feedforward module 220 of FIG. 2. Also, the buffer 300 includes a negative power supply node 320 that is coupled to an electrically neutral node (e.g., ground or virtual ground) of the linear voltage regulator.

The buffer 300 includes a first NFET 324 that has a gate coupled to the input node 308, and a source coupled to the output node 312. Also, the buffer 300 includes a second NFET 328 that has a source coupled to the output node 312 of the buffer 300. A gate of the second NFET 328 is coupled to an output node of a super source follower 330. The buffer 300 includes a first PFET 332, a second PFET 336 and a third PFET 340, in which the first PFET 332, the second PFET 336 and the third PFET 340 have a source coupled to the positive power supply node 304. Moreover, a gate of the first PFET 332 and a drain of the first PFET 332 are coupled together at a node 342. The drain of the first PFET 332 is coupled to a drain of the first NFET 324. A gate of the second PFET 336 and a gate of the third PFET 340 are also coupled to the node 342. Accordingly, the second PFET 336 and the third PFET 340 are arranged in a current mirror with the first PFET 332.

A drain of the second PFET 336 is coupled to the control node 316 of the buffer 300, an input node of the super source follower 330 and to a first bias current source 344. The first bias current source 344 is also coupled to the negative power supply node 320. Also, a second bias current source 348 is coupled between the output node 312 and the negative power supply node 320. A coupling capacitor 352, $C_{GPASS}$ is coupled in parallel with the second bias current source 348. A drain of the third PFET 340 is coupled to a positive power supply node 356 of the super source follower 330. In operation, the buffer 300 is configured such that the output voltage of the buffer 300, $V_{BUFF}$ is about equal to the input voltage, Vx plus the noise rejection signal, $V_{NOISE_REJ}$. That is, $V_{BUFF} \approx V_X + V_{NOISE_REJ}$.

Figure 4:
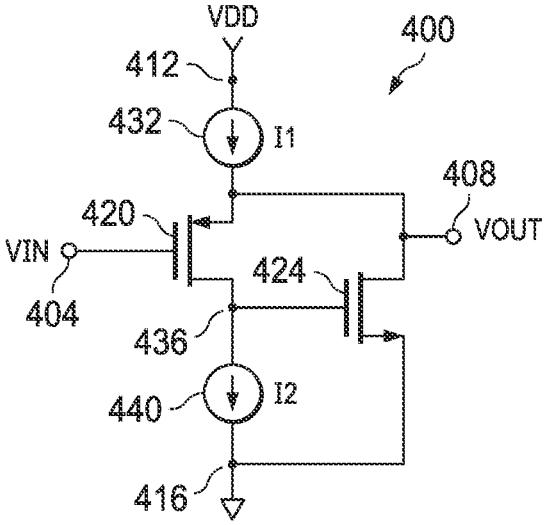
FIG. 4 is a circuit diagram of a super source follower for the buffer of FIG. 3.

FIG. 4 illustrates a circuit diagram of a super source follower 400 that is employable as the super source follower 330 of FIG. 3. Thus, the same reference numbers and nomenclature is employed in FIGS. 3 and 4 to denote the same structure and signals. The super source follower 400 includes a control node 404 and an output node 408. The control node 404 receives an input voltage, VIN and the output node 408 provides an output voltage, VOUT. The super source follower 400 includes a positive power supply node 412 coupled to a drain voltage, VDD and a negative power supply node 416 coupled to an electrically neutral node (e.g., ground or virtual ground).

The super source follower 400 includes a PFET 420 and an NFET 424. A source of the PFET 420 and a drain of the NFET 424 are coupled to the output node 408. Also, a first current source 432 is coupled to the positive power supply node 412, which provides a first current, I1 that flows from the positive power supply node 412 to the output node 408. Also, a gate of the NFET 424 and a drain of the PFET 420 are coupled to a node 436. A source of the NFET 424 is coupled to the negative power supply node 416 of the super source follower 400. Further, a second current source 440 is coupled between the node 436 and the negative power supply node 416.

In operation, the super source follower 400 operates as a buffer such that the output voltage, VOUT of the super source follower 400 is about equal to the input voltage, VIN. That is, VOUT≈VIN. Moreover, because the input voltage, VIN is provided to a gate of the PFET 420, the super source follower 400 has a high input impedance (e.g., 1 megaohm or more).

Referring back to FIG. 2, in the linear voltage regulator 200, the power transistor 224 is implemented as an NFET. Moreover, the output voltage, $V_{BUFF}$ of the buffer 212 is provided to a node 228 that is coupled to a gate (e.g., a control node) of the power transistor 224. A drain (an input node) of the power transistor 224 is coupled to a voltage input 232 of the linear voltage regulator 200 that is coupled to the input voltage, VIN, and a source (an output node) of the power transistor 224 is coupled to the voltage output 208 of the linear voltage regulator 200.

The output of the buffer 212 is also provided to a dropout detection module 240. The dropout detection module 240 includes a control node 242 coupled to a node 228, and an output node 246 that is coupled to the feedforward module 220. The dropout detection module 240 also includes a power input node 248 coupled to the voltage input 232 that is coupled to the input voltage, VIN and a power output node 250 coupled to the voltage output 208 that provides the output voltage, VOUT for the linear voltage regulator 200.

The dropout detection module 240 includes a voltage source 252, a first NFET 254 and a second NFET 258. The first NFET 254 is alternatively referred to as a sensing transistor or sensing NFET and the second NFET 258 is alternatively referred to as a boost transistor or boost NFET. The first NFET 254 of the dropout detection module 240 is a scaled-down version of the power transistor 224. More particularly, the power transistor 224 has a channel size about three orders of magnitude (1000 times) larger than a channel size of the first NFET 254. A gate of the first NFET 254 is coupled to the control node 242 of the dropout detection module 240, such that the gate of the first NFET 254 is also coupled to the gate of the power transistor 224. Also, a source of the first NFET 254 is coupled to the power output node 250 of the dropout detection module 240 and a drain of the first NFET 254 is coupled to the output node 246 of the dropout detection module 240.

Figure 5:
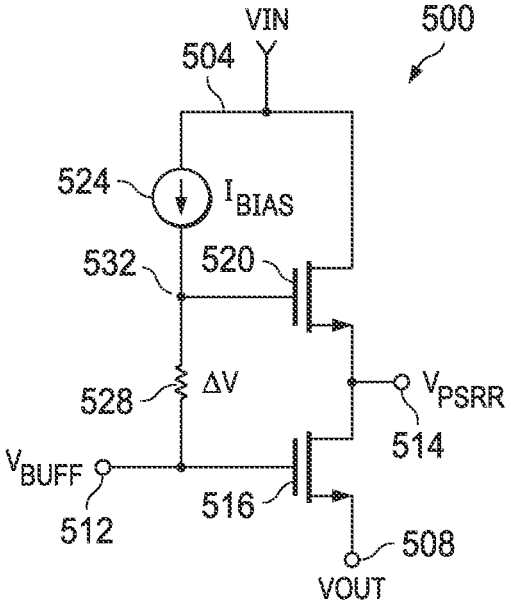
FIG. 5 is a circuit diagram of a dropout detection module for the linear voltage regulator of FIG. 2.

FIG. 5 illustrates a circuit diagram of a dropout detection module 500 for a linear voltage regulator, such as the linear voltage regulator 200 of FIG. 2. The dropout detection module 500 is employable to implement the dropout detection module 240 of FIG. 2. Thus, the same reference numbers and nomenclature is employed in FIGS. 5 and 4 to denote the same structure and signals. The dropout detection module 500 includes a power input node 504 that is coupled to an input voltage, VIN such as the input voltage, VIN of FIG. 1. The dropout detection module 500 also includes a power output node 508 that is coupled to an output node of the voltage regulator, such that an output voltage, VOUT is applied to the power output node 508.

The dropout detection module 500 includes a control node 512 that is coupled to an output of a buffer (e.g., the buffer 212 of FIG. 2), such that a buffer output voltage, $V_{BUFF}$ is applied to the control node 512. The dropout detection module 500 includes an output node 514 that provides a PSRR signal, $V_{PSRR}$. The dropout detection module 500 includes a first NFET 516 and a second NFET 520. The first NFET 516 is employable to implement the first NFET 254 of the dropout detection module 240 of FIG. 2 and the second NFET 520 is employable to implement the second NFET 258 of the dropout detection module 240 of FIG. 2. The dropout detection module 500 includes a current source 524 that provides a bias current, $I_{BIAS}$ and a resistor 528. As one example, the bias current, $I_{BIAS}$ is about 8 microamperes (μA).

A gate of the first NFET 516 is coupled to the control node 512. Also, a source of the first NFET 516 is coupled to the power output node 508 and a drain of the first NFET 516 is coupled to the output node 514 of the dropout detection module 500. The current source 524 is coupled to the power input node 504 and to a gate of the second NFET 520 at a node 532. The resistor 528 is also coupled to the node 532. A drain of the second NFET 520 is coupled to the power input node 504. The current source 524 induces a voltage drop of a delta voltage, ΔV across the resistor 528. Thus, a voltage level at the gate of the second NFET 520 is greater than a voltage level at the gate of the first NFET 516 by the delta voltage, ΔV. Accordingly, a combination of the current source 524 and the resistor 528 provide the voltage source 252 of FIG. 2.

Referring back to FIG. 2, The voltage source 252 provides a voltage drop equal to a delta voltage, ΔV between the gate of the first NFET 254 and a gate of the second NFET 258. That is, a positive terminal of the voltage source 252 is coupled to the gate of the second NFET 258 and a negative terminal of the voltage source 252 is coupled to the gate of the first NFET 254 and to the control node 242 of the dropout detection module 240. A source of the second NFET 258 is coupled to the output node 246 of the dropout detection module 240, such that the source of the second NFET 258 is coupled to the drain of the first NFET 254. A drain of the second NFET 258 is coupled to the power input node 248 of the dropout detection module 240, such that the drain of the second NFET 258 is coupled to the input voltage, VIN.

The feedforward module 220 includes a control node 264 that is coupled to the output node 246 of the dropout detection module 240 and an output node 268 that is coupled to the control node 216 of the buffer 212. The feedforward module 220 also includes a positive power supply node 272 that is coupled to the supplemental supply voltage, VHV and a negative power supply node 274 that is coupled to an electrically neutral node (e.g., ground or virtual ground) of the linear voltage regulator 200.

The feedforward module 220 includes a first current source 276 and a second current source 278, as well as a third NFET 280 and a fourth NFET 282. The first current source 276 provides a bias current, Isms flowing from the positive power supply node 272 to a drain and a gate of the third NFET 280, such that the drain and the gate of the third NFET 280 are coupled together. A source of the third NFET 280 is coupled to the negative power supply node 274 of the feedforward module 220. The second current source 278 provides the bias current, Isms flowing from the positive power supply node 272 to a drain of the fourth NFET 282. A source of the fourth NFET 282 is coupled to the negative power supply node 274 of the feedforward module 220. As one example, Isms is about 8 μA.

The third NFET 280 and the fourth NFET 282 are connected as a current mirror, such that a current of the drain, Isms on the fourth NFET 282 is equal to the current of the drain on the third NFET 280. The gate of the third NFET 280 is coupled to a first node of a power supply rejection ratio resistor 284 ($R_{PSRR}$). As one example, the power supply rejection ratio resistor 284 has a resistance of about 2 megaohms (MO). Also, a second node of the power supply rejection ratio resistor 284 is coupled to a node 286. The node 286 is coupled to a gate of the fourth NFET 282 and a first node of a power supply rejection ratio capacitor 288 ($C_{PSRR}$). As one example, the power supply rejection ratio capacitor 288 has a capacitance of about 20 picofarads (pF). A second node of the power supply rejection ratio capacitor 288 is coupled to the control node 264 of the feedforward module 220.

In operation, the buffer 212 outputs the buffer voltage signal, $V_{BUFF}$ in response to the voltage signal Vx output by the op-amp 204. In response to the buffer voltage signal, $V_{BUFF}$, the power transistor 224 provides the output voltage, VOUT to the load 202 that varies as a function of the buffer voltage signal, $V_{BUFF}$. The linear voltage regulator 100 is configured such that if the output voltage, VOUT rises too high relative to the reference voltage, VREF, the buffer voltage signal, $V_{BUFF}$ is adjusted to control the power transistor 120 to maintain a constant output voltage, VOUT.

As illustrated, a drain to source voltage, VDS of the power transistor 224 is equal to the input voltage, VIN minus the output voltage, VOUT (e.g., $V_{DS}$=VIN−VOUT) of the linear voltage regulator 200. Accordingly, in situations where the difference between the input voltage, VIN and the output voltage (VIN-VOUT) is greater than or equal to a threshold voltage, $V_{THRESH}$, the power transistor 224 operates in the saturation region, such that noise injected into the input voltage, VIN is filtered by the buffer 212. Because the input voltage, VIN minus the output voltage, VOUT (VIN-VOUT) is equal to the drain to source voltage VDS of the power transistor 224, in some examples, the threshold voltage, $V_{THRESH}$ is set to a voltage level that is about equal to an overdrive voltage, $V_{OV}$ of the power transistor 224.

The noise injected into the input voltage, VIN is represented as $V_{IN_AC}$. Noise at the output voltage, VOUT is represented as VOUT_AC. If the power transistor 224 operates in the saturation region, VOUT_AC is at least one order of magnitude (1/10) less than $V_{IN_AC}$. For instance, if the threshold voltage, $V_{THRESH}$ is equal to 1 V, and the voltage, VOUT is at least 1 V less than the input voltage, VIN the power transistor 224 operates in the saturation region and the op-amp 204, the buffer 212 and the power transistor 224 operate in concert to filter noise, $V_{IN_AC}$ present in the input voltage, VIN. Also, during intervals where the power transistor 224 operates in the saturation region, a noise component of the PSRR signal, $V_{PSRR}$, represented as $V_{PSRR_AC}$ is reduced to about 0 V. Specifically, if the power transistor 224 operates in the saturation region, both the first NFET 254 and the second NFET 258 also operate in the saturation region, which reduces the PSRR signal, $V_{PSRR}$ (including the noise component $V_{PSRR}$_AC) a the output node 246 of the dropout detection module 240 to a level that is about 0 volts. That is, during these intervals where the first NFET 254 and the second NFET 258 are operating in the saturation region, the PSRR signal, $V_{PSRR}$ is de-asserted.

However, in situations where VIN-VOUT approaches the threshold voltage, $V_{THRESH}$, the power transistor 224 and the first NFET 254 of the dropout detection module 240 transitions from operating in the saturation region to the linear region, such as in response to an increase in the load current, $I_{LOAD}$. As noted, the first NFET 254 is a scaled-down version of the power transistor 224, and the gate of the first NFET 254 is coupled to the gate of the power transistor 224. Thus, as the power transistor 224 transitions from the saturation region to the linear region, the first NFET 254 also transitions from the saturation region to the linear region. Also, the dropout detection module 240 is configured with the delta voltage, ΔV that is experimentally determined and is less than the threshold voltage, $V_{THRESH}$ (e.g., $\Delta V<V_{THRESH}$). Due to the delta voltage, ΔV, as the first NFET 254 transitions from the saturation region to the linear region, the second NFET 258 remains in the saturation region. Accordingly, voltage at the output node 246 increases as the first NFET 254 transitions from the saturation region to the linear region. Thus, the PSRR signal, $V_{PSRR}$ is asserted at the output node 246 of the dropout detection module 240. Accordingly, the second NFET 258 and the first NFET 254 of the dropout detection module 240 operate in concert to sense the buffer voltage signal, $V_{BUFF}$ and asserts the PSRR signal, $V_{PSRR}$ (that includes the noise component, $V_{PSRR_AC}$) if a voltage difference between a voltage level of the input voltage, VIN and a voltage level at the voltage output, VOUT is less than the threshold voltage, $V_{THRESH}$ causing the power transistor 224 to transition to the linear region. In this situation, the noise of the PSRR signal, $V_{PSRR_AC}$ is an amplified version of the noise at the input voltage, $V_{IN_AC}$. Stated differently, the dropout detection module 240 asserts the PSRR signal, $V_{PSRR}$ if $VOUT-VIN<V_{THRESH}$. Further, the dropout detection module 240 de-asserts the PSRR signal, $V_{PSRR}$ if the voltage difference between the voltage level of the voltage input voltage, VIN and the voltage level at the voltage output, VOUT is greater than or equal to the threshold voltage, $V_{THRESH}$, indicating that the power transistor 224 is transitioning to the saturation region.

The feedforward module 220 receives the (asserted) PSRR signal, $V_{PSRR}$ and the power supply rejection ratio capacitor 288 blocks the direct current (DC) portion of the PSRR signal, $V_{PSRR}$, such that the noise component of the PSRR signal, $V_{PSRR_AC}$ is provided to the node 286 and amplified by the fourth NFET 282 of the feedforward module 220. In particular, the drain of the fourth NFET 282 that is coupled to the output node 268 of the feedforward module 220 outputs a noise rejection signal, $V_{NOISE_REJ}$ (alternatively referred to as a feedforward signal) is an amplified and inverted version of the PSRR signal, $V_{PSRR_AC}$, which in turn is an amplified version of the noise in the input voltage, $V_{IN_AC}$. Conversely, in response to de-assertion of the PSRR signal, $V_{PSRR}$, the feedforward module 220 de-asserts the noise rejection signal, $V_{NOISE_REJ}$. In this manner, the dropout detection module 240 and the feedforward module 220 operate in concert to selectively provide a PSRR boost.

Responsive to injection of the noise rejection signal, $V_{NOISE_REJ}$, the buffer 212 and the power transistor 224 operate in concert to filter noise in the input voltage, VIN. More particularly, injection of the noise rejection signal, $V_{NOISE_REJ}$ injects an inverted version of the noise at the input voltage, $V_{IN_AC}$ into the output of the buffer 212, $V_{BUFF}$. Accordingly, the inverted version of the noise the input voltage, $V_{IN_AC}$ is included in the signal driving the gate of the power transistor 224, such that the power transistor 224 cancels out the noise component from the input voltage, $V_{IN_AC}$ during amplification of the input voltage, VIN during operation in the linear region, such that noise in the output voltage, VOUT_AC is curtailed.

Accordingly, the dropout detection module 240 selectively activates the feedforward module 220 during time intervals where the voltage difference between the input voltage, VIN and the voltage output, VOUT is less than the threshold voltage, $V_{THRESH}$ (e.g., during time intervals where $VOUT-VIN<V_{THRESH}$). For example, the PSRR signal, $V_{PSRR}$ is asserted during time intervals where the load current, $I_{LOAD}$ increases to a level that causes the voltage difference between the input voltage, VIN and the output voltage, VOUT to be less than the threshold voltage, $V_{THRESH}$. Similarly, the feedforward module 220 is deactivated during time intervals where the voltage difference between the input voltage, VIN and the voltage output, VOUT is greater or equal to the threshold voltage, $V_{THRESH}$ (e.g., during time intervals where VIN-VOUT $V_{THRESH}$). In this manner, the dropout voltage of the linear voltage regulator 200 and/or a size of the power transistor 224 is reducible without a reduction in power efficiency of the linear voltage regulator 200, in contrast to conventional techniques for lowering the dropout voltage.

Figure 6:
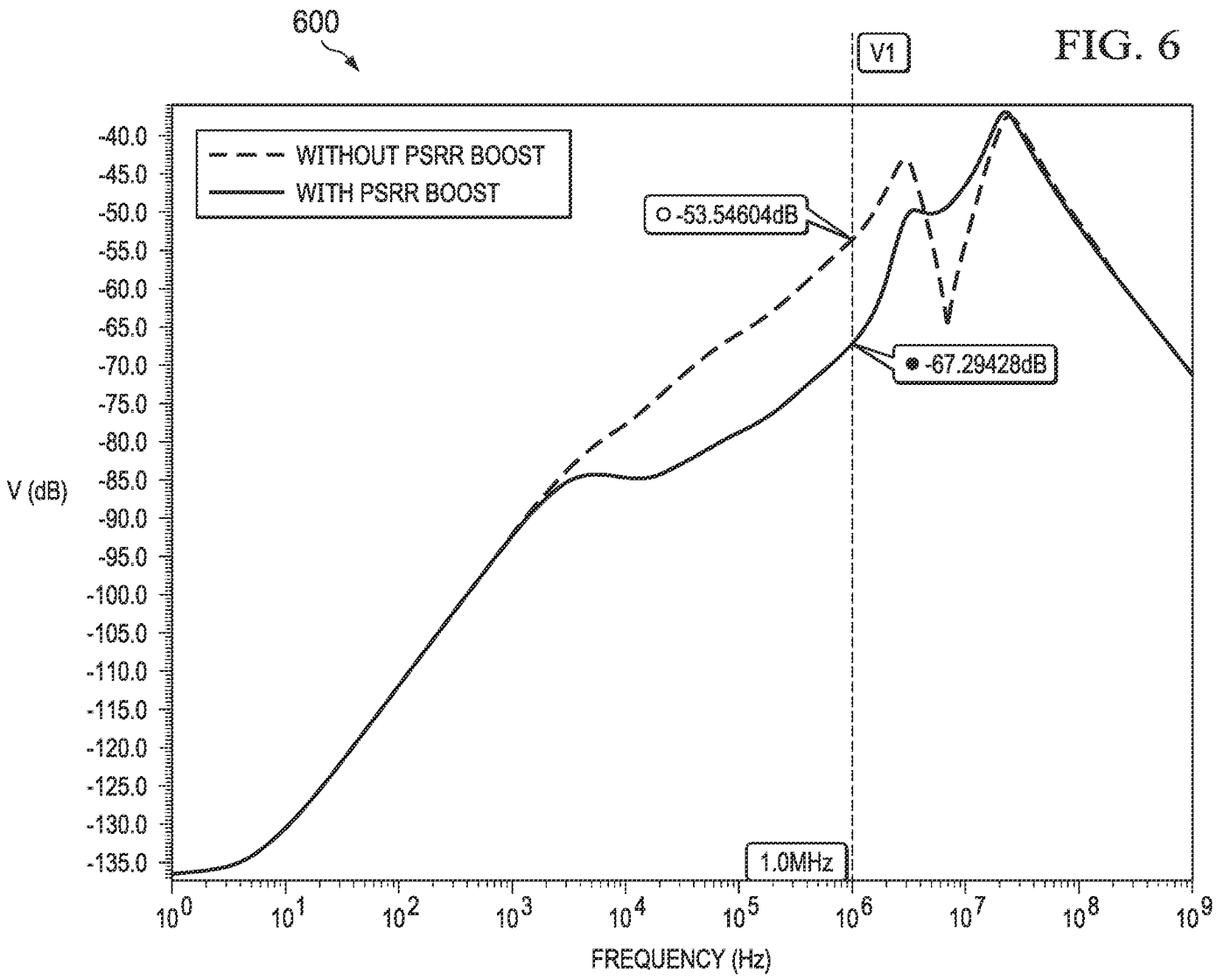
FIG. 6 is a graph plotting a voltage gain of noise as a function of frequency for the linear voltage regulator of FIG. 2.

FIG. 6 illustrates a graph 600 that includes plots of a voltage gain, Av in decibels (dB) of noise as a function of frequency in hertz (Hz) using Equation 1. The graph 600 includes a first plot with a PSRR boost using the linear voltage regulator 200, in which the delta voltage, ΔV is set to 200 millivolts (mV) and VIN-VOUT, which also defines VDS for the power transistor 224 is 400 mV. Also, for purposes of comparison the graph 600 includes a second plot using a conventional voltage regulator circuit, in which the dropout detection module 240 and the feedforward module 220 of FIG. 2 have been omitted, such that the linear voltage regulator operates without a PSRR boost. Because the graph 600 plots the gain of noise (VOUT_AC/VIN_AC), lower gain, Δv (more negative) corresponds to increased performance of the linear voltage regulator.

$$Av = 20\log\left(\frac{\text{VOUT_AC}}{\text{VIN_AC}}\right) \qquad \text{Equation 1}$$

As illustrated, the PSRR boost provided by the dropout detection module 240 and the feedforward module 220 the linear voltage regulator 200 provides increased PSRR for noise at frequencies of about 1 kHz ($10^3$ Hz) to about 1 MHz ($10^6$ Hz).

Figure 7:
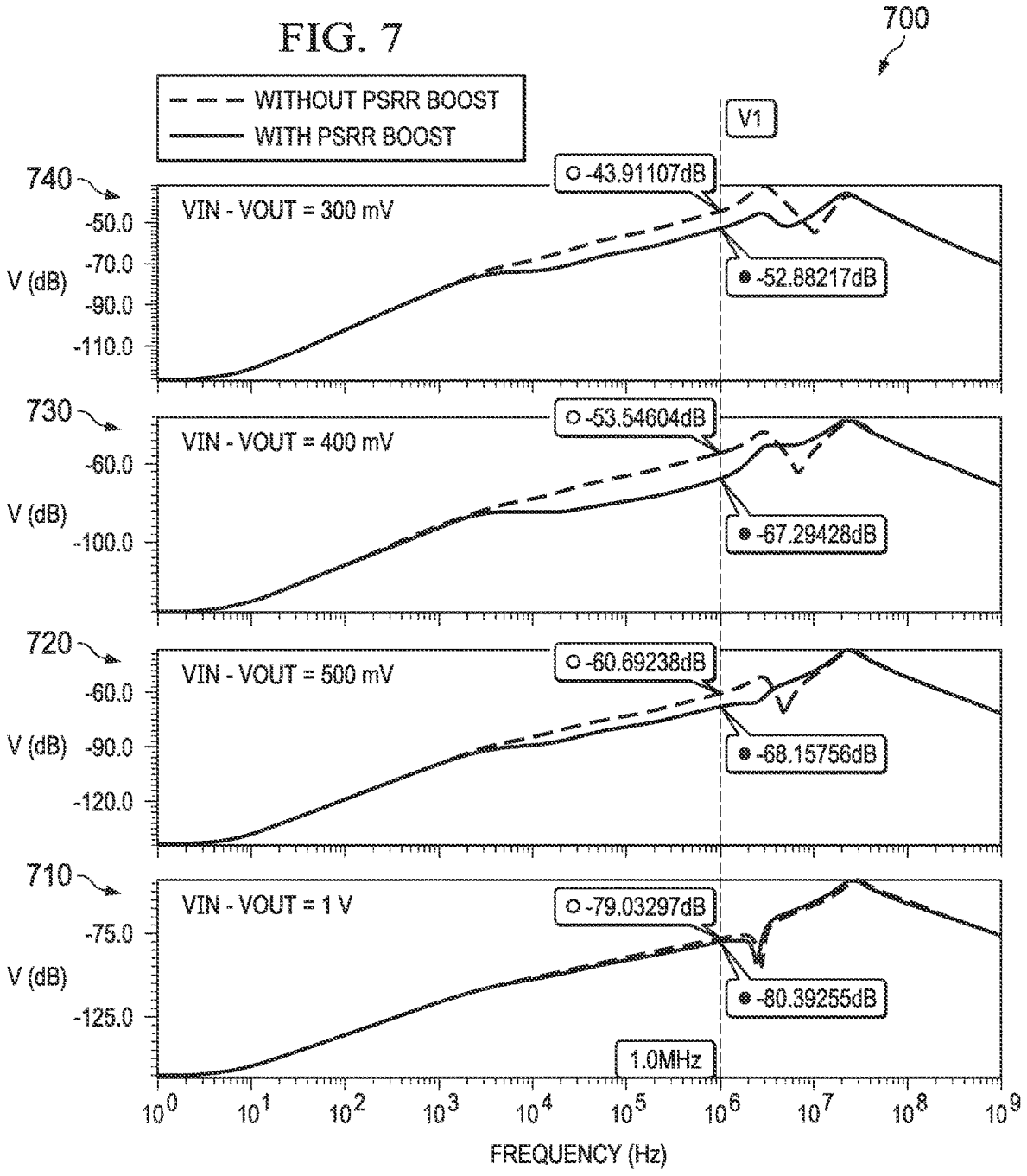
FIG. 7 is multiple graphs plotting a voltage gain of noise as a function of frequency for a changing difference between an input voltage and an output voltage for the linear voltage regulator of FIG. 2.

FIG. 7 illustrates graphs 700 that plot a voltage gain, Av in decibels (dB) of noise as a function of frequency in hertz (Hz) using Equation 1. The graphs 700 demonstrate that PSRR increases as VIN-VOUT for the linear voltage regulator 200 of FIG. 2 decreases. As noted, in the linear voltage regulator 200, VIN-VOUT also defines $V_{DS}$ for the power transistor 224 of the linear voltage regulator 200. In the graphs 700, the delta voltage, ΔV is set to 200 mV and the load current, $I_{LOAD}$ is set to 5 amperes (A). Each of the graphs 700 includes a first plot with a PSRR boost using the linear voltage regulator 200 and a second plot using a conventional voltage regulator circuit, in which the dropout detection module 240 and the feedforward module 220 of FIG. 2 have been omitted, such that the linear voltage regulator operates without a PSRR boost. The graphs 700 include a first graph 710 with a VIN-VOUT of 1 V and a second graph 720 with a VIN-VOUT of 500 mV. Also, the graphs 700 include a third graph 730 with a VIN-VOUT of 400 mV and a fourth graph 740 with a VIN-VOUT of 300 mV.

As is illustrated by the graph 600 of FIG. 6 and the graphs 700 of FIG. 7, as the VDS (and VIN-VOUT) of the power transistor 224 of the linear voltage regulator 200 decreases, the power transistor 224 transitions from the saturation region to the linear region, and the PSRR boost increases the PSRR provided by the dropout detection module 240 and the feedforward module 220 of the linear voltage regulator 200. Also, as illustrated specifically by the first graph 710 of the graphs 700, during time intervals where the power transistor 224 is operating in the saturation region (e.g., VDS of the power transistor 224 is 1 V or more), the PSRR boost provides a negligible benefit. Accordingly, as explained above, the dropout detection module 240 selectively asserts and de-asserts the PSRR signal, $V_{PSRR}$ to avoid a loss of power efficiency.

Figure 8:
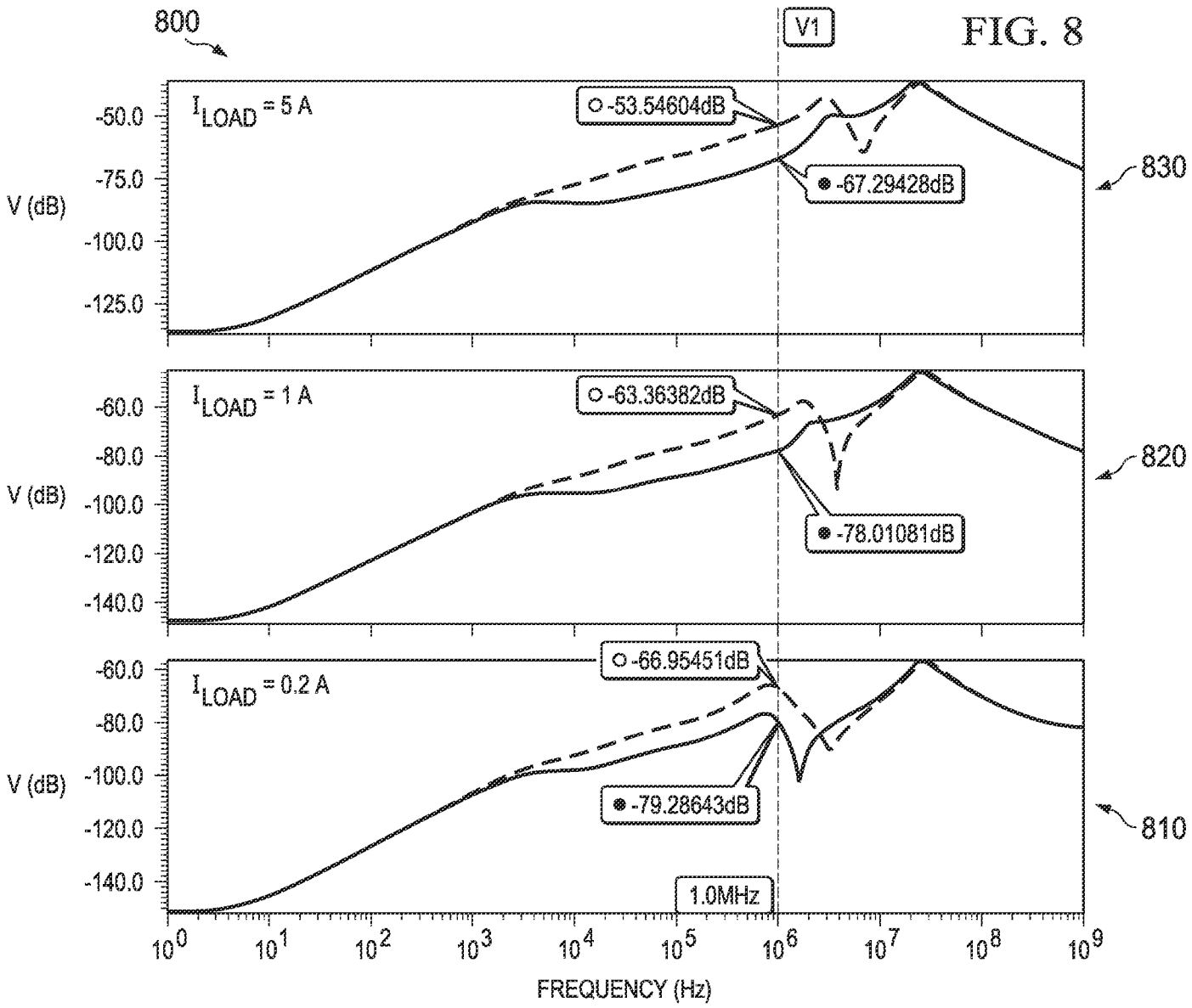
FIG. 8 is multiple graphs plotting a voltage gain of noise as a function of frequency for a changing load current for the linear voltage regulator of FIG. 2.

FIG. 8 illustrates graphs 800 that plot a voltage gain, Av in decibels (dB) of noise as a function of frequency in hertz (Hz) using Equation 1. The graphs 800 demonstrate that PSRR increases over a range of output current, $I_{LOAD}$ for the linear voltage regulator 200 of FIG. 2, which input voltage, VIN minus the output voltage, VOUT minus the (VIN-VOUT), which also defines the VDS of the power transistor 224, remains constant at 400 mV. In the graphs 700, the delta voltage, ΔV is set to 200 mV. Each of the graphs 700 includes a first plot with a PSRR boost using the linear voltage regulator 200 and a second plot using a conventional voltage regulator circuit, in which the dropout detection module 240 and the feedforward module 220 of FIG. 2 have been omitted, such that the linear voltage regulator operates without a PSRR boost. The graphs 800 include a first graph 810 with an output current, $I_{LOAD}$ of 0.2 A and a second graph 820 with an output current, $I_{LOAD}$ of 1 A. Also, the graphs 800 include a third graph 830 with an output current, $I_{LOAD}$ of 5 A. As is illustrated, by the graphs 800, the performance of the linear voltage regulator 200 with the PSRR boost increases for a relatively wide range of output currents, $I_{LOAD}$.

Figure 9:
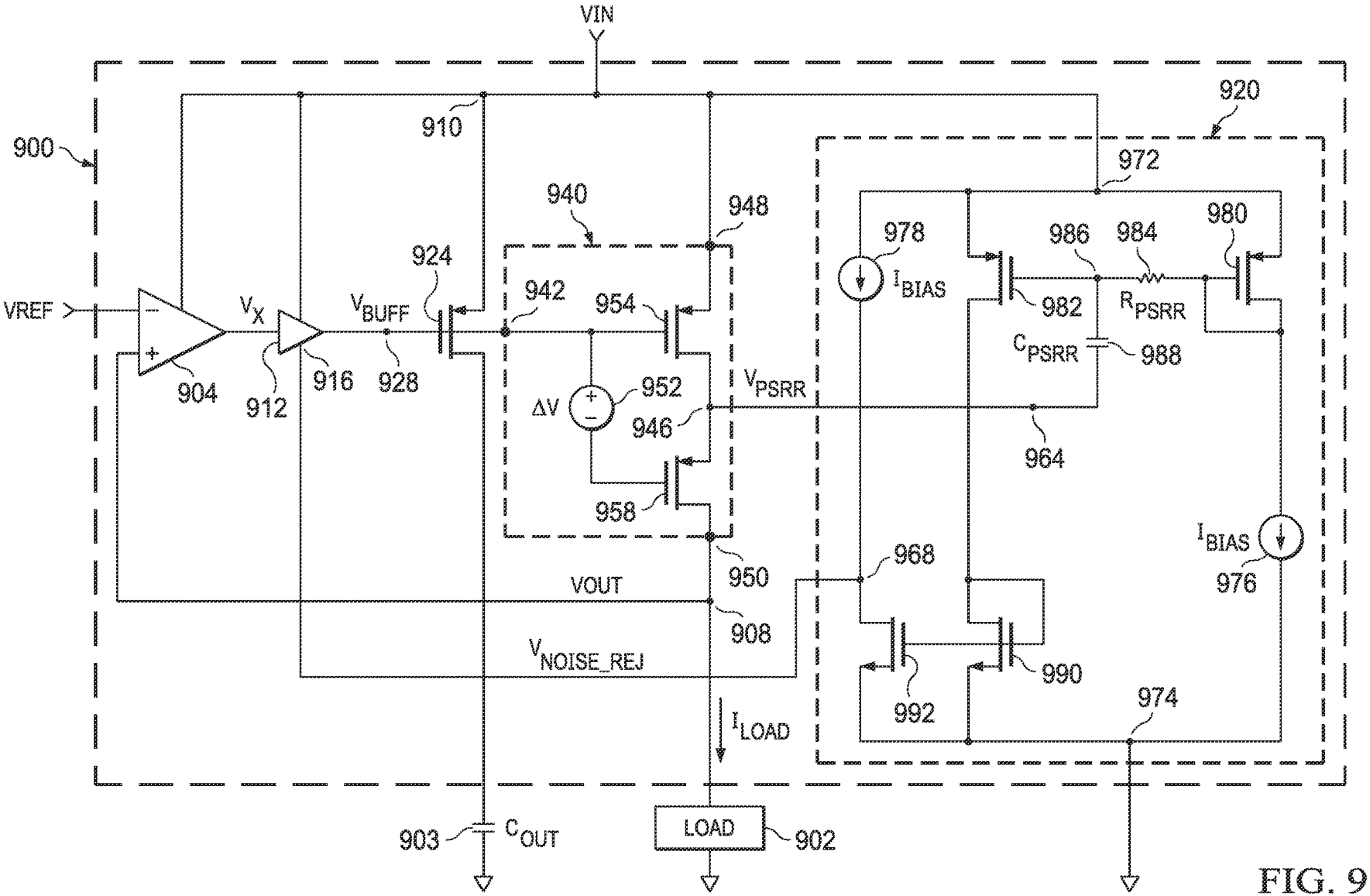
FIG. 9 is a circuit diagram of another example of a linear voltage regulator.

FIG. 9 illustrates another circuit diagram of a linear voltage regulator 900 that is employable to implement the linear voltage regulator 100 of FIG. 1. The linear voltage regulator 900 implements a linear voltage regulator circuit, such as an LDO. Accordingly, the linear voltage regulator 900 receives an input voltage, VIN, a reference voltage, VREF and outputs an output voltage, VOUT to a load 902 and to an output capacitor 903 ($C_{OUT}$) that is in parallel with the load 902. As one example, the output capacitor 903 has a capacitance of about 150 picofarads (pF). The output voltage, VOUT induces a load current, $I_{LOAD}$ at the load 902. The linear voltage regulator 900 is configured such that the load current, $I_{LOAD}$ varies as a function of time, and the output voltage, VOUT remains about constant in situations where an input voltage, VIN experiences noise, such as frequency spurs, voltage flickers, etc. In the example illustrated, the input voltage, VIN supplies power to components of the linear voltage regulator 900, such that a the linear voltage regulator 900 has a single voltage source, namely the input voltage, VIN.

The linear voltage regulator 900 has a power supply rejection ratio (PSRR) that characterizes the capability of the linear voltage regulator 900 to suppress power supply variations present in the input voltage, VIN from the output voltage, VOUT. The linear voltage regulator 900 includes an op-amp 904, and the reference voltage, VREF is provided to an inverting input of the op-amp 904. A non-inverting input of the op-amp 904 is coupled to a voltage output 908 of the linear voltage regulator 900, in which the voltage output 908 of the linear voltage regulator 900 provides the output voltage, VOUT. Also, an output of the op-amp 904, Vx is provided to an input of a buffer 912. The buffer 912 and the op-amp 904 have a power supply node coupled to a voltage input 910 of the linear voltage regulator 900 that is coupled to the input voltage, VIN. Also, the buffer 912 includes a control node 916 that receives a noise rejection signal, $V_{NOISE_REJ}$ from a feedforward module 920. The buffer 912 provides an output voltage, $V_{BUFF}$ to a power transistor 924.

Figure 10:
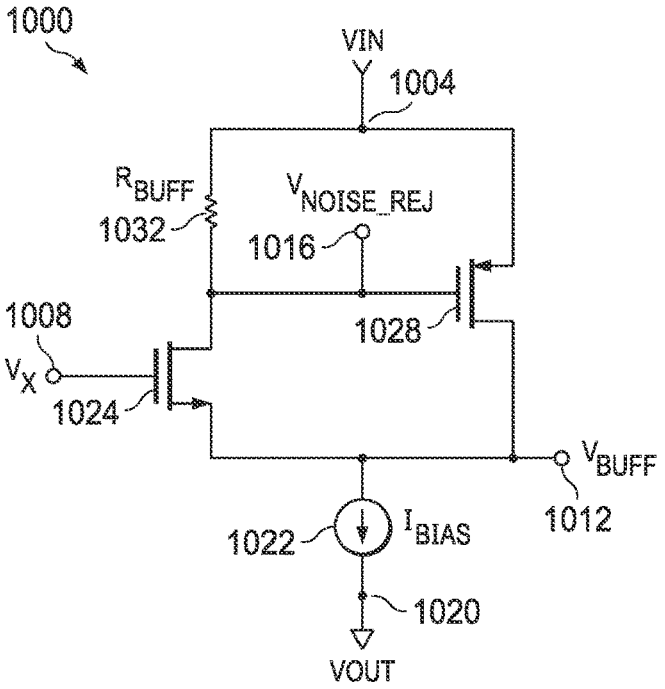
FIG. 10 is a circuit diagram of a buffer for the linear voltage regulator of FIG. 9.

FIG. 10 illustrates a circuit diagram for a buffer 1000 for a linear voltage regulator, such as the linear voltage regulator 900 of FIG. 9. The buffer 1000 is employable to implement the buffer 912 of FIG. 9. Thus, the same reference numbers and nomenclature is employed in FIGS. 9 and 10 to denote the same structure and signals. The buffer 1000 includes a positive power supply node 1004 that is coupled to the input voltage, VIN. The buffer 1000 includes an input node 1008 that receives a voltage, Vx output from an op-amp, such as the op-amp 904 of FIG. 1 and an output node 1012 that provides an output signal for the buffer 1000, $V_{BUFF}$. The buffer 1000 also includes a control node 1016 that receives the noise rejection signal, $V_{NOISE_REJ}$ from the feedforward module 920 of FIG. 9. Also, the buffer 1000 includes a negative power supply node 1020 that is coupled to an electrically neutral node (e.g., ground or virtual ground) of the linear voltage regulator. A current source 1022 is coupled between the negative power supply node 1020 and the output node 1012. The current source 1022 causes a bias current, $I_{BIAS}$ to flow from the output node 1012 to the negative power supply node 1020. As one example, the bias current, $I_{BIAS}$ is about 3 microamperes (μA)

The buffer 1000 includes an NFET 1024 that has a gate coupled to the input node 1008, and a source coupled to the output node 1012. A drain of the NFET 1024 is coupled to the control node 1016 of the buffer 1000. Also, the buffer 1000 includes a PFET 1028 that has a source coupled to the positive power supply node 1004. A gate of the PFET 1028 is coupled to the control node 1016 and a drain of the PFET 1028 is coupled to the output node 1012. Further, a resistor 1032, $R_{BUFF}$ is coupled between the positive power supply node 1004 and the control node 1016. In operation, the buffer 1000 is configured such that the output voltage of the buffer 1000, $V_{BUFF}$ is about equal to the input voltage, Vx plus the noise rejection signal, $V_{NOISE_REJ}$. That is, $V_{BUFF} \approx V_X + V_{NOISE_REJ}$.

Referring back to FIG. 9, in the linear voltage regulator 900, the power transistor 924 is implemented as a PFET. Moreover, the output voltage, $V_{BUFF}$ of the buffer 912 is provided to a node 928 that is coupled to a gate (a control node) of the power transistor 924. A source (an input node) of the power transistor 924 is coupled to the voltage input 910 that is coupled to the input voltage, VIN, and a drain (an output node) of the power transistor 924 is coupled to the voltage output 908 of the linear voltage regulator 900.

The output of the buffer 912 is also provided to a dropout detection module 940. The dropout detection module 940 includes a control node 942 coupled to the node 928, and an output node 946 that is coupled to the feedforward module 920. The dropout detection module 940 also includes a power input node 948 coupled to the voltage input 910 that is coupled to the input voltage, VIN and a power output node 950 coupled to the voltage output 908 that provides the output voltage, VOUT for the linear voltage regulator 900.

The dropout detection module 940 includes a voltage source 952, a first PFET 954 and a second PFET 958. The first PFET 954, alternatively referred to as a sensing transistor or sensing PFET, and the second PFET 958 is alternatively referred to as a boost transistor or boost PFET. The first PFET 954 of the dropout detection module 940 is a scaled-down version of the power transistor 924. More particularly, the power transistor 924 has a channel size about three orders of magnitude (1000 times) larger than a channel size of the first PFET 954. A gate of the first PFET 954 is coupled to the control node 942 of the dropout detection module 940, such that the gate of the first PFET 954 is also coupled to the gate of the power transistor 924.

Also, a source of the first PFET 954 is coupled to the power input node 948 of the dropout detection module 940 and a drain of the first PFET 954 is coupled to the output node 946 of the dropout detection module 940.

The voltage source 952 provides a voltage drop equal to a delta voltage, ΔV between the gate of the first PFET 954 and a gate of the second PFET 958. That is, a positive terminal of the voltage source 952 is coupled to the gate of the first PFET 954 and to the control node 942 of the dropout detection module 940 and a negative terminal of the voltage source 952 is coupled to the gate of the second PFET 958. A source of the second PFET 958 is coupled to the output node 946 of the dropout detection module 940, such that the source of the second PFET 958 is coupled to the drain of the first PFET 954. A drain of the second PFET 958 is coupled to the power output node 950 of the dropout detection module 940, such that the drain of the second PFET 958 is coupled to the output voltage, VOUT.

Figure 11:
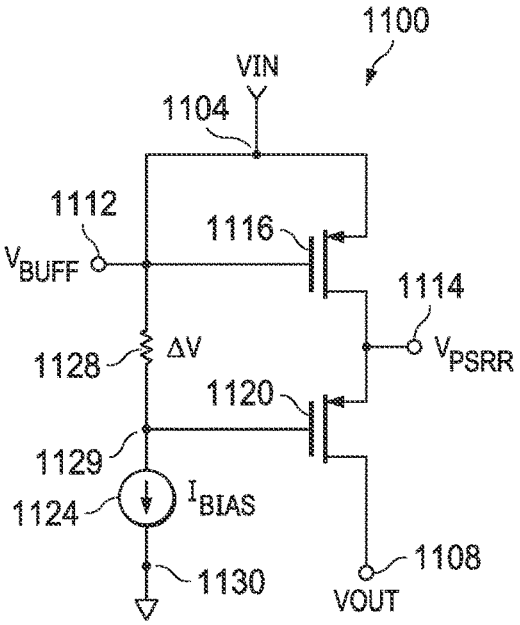
FIG. 11 is a circuit diagram of a dropout detection module for the linear voltage regulator of FIG. 9.

FIG. 11 illustrates a circuit diagram of a dropout detection module 1100 for a linear voltage regulator, such as the linear voltage regulator 900 of FIG. 9. The dropout detection module 1100 is employable to implement the dropout detection module 940 of FIG. 9. Thus, the same reference numbers and nomenclature is employed in FIGS. 9 and 11 to denote the same structure and signals. The dropout detection module 1100 includes a power input node 1104 that is coupled to an input voltage, VIN such as the input voltage, VIN of FIG. 1. The dropout detection module 1100 also includes a power output node 1108 that is coupled to an output node of the voltage regulator, such that an output voltage, VOUT of the linear voltage regulator is applied to the power output node 1108.

The dropout detection module 1100 includes a control node 1112 that is coupled to an output of a buffer (e.g., the buffer 912 of FIG. 9), such that a buffer output voltage, $V_{BUFF}$ is applied to the control node 1112. The dropout detection module 1100 includes an output node 1114 that provides a PSRR signal, $V_{PSRR}$. The dropout detection module 1100 includes a first PFET 1116 and a second PFET 1120. The first PFET 1116 is employable to implement the first PFET 954 of the dropout detection module 940 of FIG. 9 and the second PFET 1120 is employable to implement the second PFET 958 of the dropout detection module 940 of FIG. 9. The dropout detection module 1100 includes a current source 1124 that provides a bias current, $I_{BIAS}$. Also, the dropout detection module 1100 includes a resistor 1128 coupled between a gate of the first PFET 1116 and a gate of the second PFET 1120. More specifically, a first node of the resistor 1128 is coupled to the control node 1112 of the dropout detection module 1100, which is coupled to the gate of the first PFET 1116. A second node of the resistor 1128 is coupled to a node 1129. The node 1129 is coupled to the current source 1124 and to the gate of the second PFET 1120. The current source 1124 is also coupled to an electrically neutral node 1130 (e.g., ground or virtual ground). As one example, the bias current, $I_{BIAS}$ is about 3 μA.

Also, a source of the first PFET 1116 is coupled to the power input node 1104 and a drain of the first PFET 1116 is coupled to the output node 1114 of the dropout detection module 1100. A source of the second PFET 1120 is coupled to the output node 1114, and a drain of the second PFET 1120 is coupled to the power output node 1108, which provides the output voltage, VOUT of the linear voltage regulator. The current source 1124 induces a voltage drop a delta voltage, ΔV across the resistor 1128. Thus, the voltage level at the gate of the second PFET 1120 is less than a voltage level at the gate of the first PFET 1116 by the delta voltage, ΔV. Accordingly, a combination of the current source 1124 and the resistor 1128 provide the voltage source 952 of FIG. 9.

Referring back to FIG. 9 the feedforward module 920 includes a control node 964 that is coupled to the output node 946 of the dropout detection module 940 and an output node 968 that is coupled to the control node 916 of the buffer 912. The feedforward module 920 also includes a positive power supply node 972 that is coupled to the voltage input 910 that is in turn coupled to the input voltage, VIN and a negative power supply node 974 that is coupled to an electrically neutral node (e.g., ground or virtual ground) of the linear voltage regulator 900.

The feedforward module 920 includes a first current source 976 and a second current source 978, as well as a third PFET 980 and a fourth PFET 982. The first current source 976 provides a bias current, $I_{BIAS}$ flowing a drain and a gate of the third PFET 980 to the negative power supply node 974, such that the drain and the gate of the third PFET 980 are coupled together. A source of the third PFET 980 is coupled to the positive power supply node 972 of the feedforward module 920. The second current source 978 provides the bias current, $I_{BIAS}$ flowing from the positive power supply node 972 to a drain of the fourth PFET 982. A source of the fourth PFET 982 is coupled to the negative power supply node 974 of the feedforward module 920. As one example, $I_{BIAS}$ is about 3 μA.

The third PFET 980 and the fourth PFET 982 are connected as a current mirror, such that a current of the drain on the fourth PFET 982 is equal to the current of the drain on the third PFET 980, Isms. The gate of the third PFET 980 is coupled to a first node of a power supply rejection ratio resistor 984 ($R_{PSRR}$). As one example, the power supply rejection ratio resistor 984 has a resistance of about 2 megaohms (MO). Also, a second node of the power supply rejection ratio resistor 984 is coupled to a node 986. The node 986 is coupled to a gate of the fourth PFET 982 and a first node of a power supply rejection ratio capacitor 988 ($C_{PSRR}$). As one example, the power supply rejection ratio capacitor 988 has a capacitance of about 10 picofarads (pF). A second node of the power supply rejection ratio capacitor 988 is coupled to the control node 964 of the feedforward module 920.

The feedforward module 920 also includes a first NFET 990 and a second NFET 992. A gate and a drain of the first NFET 990 are coupled together and to the drain of the fourth PFET 982. Moreover, a source of the first NFET 990 and a source of the second NFET 992 are coupled to the negative power supply node 974. Also, a gate of the second NFET 992 is coupled to a gate of the first NFET 990, such that the second NFET 992 is arranged in a current mirror configuration with the first NFET 990.

The second current source 978 is coupled to the positive power supply node 972 and to a drain of the second NFET 992. Also, the drain of the second NFET 992 is coupled to the output node 968 of the feedforward module 920. Thus, the second current source 978 causes current to flow from the positive power supply node 972 to the output node 968 and to the drain of the second NFET 992.

In operation, the buffer 912 outputs the buffer voltage signal, $V_{BUFF}$ in response to the voltage signal Vx output by the op-amp 904. In response to the buffer voltage signal, $V_{BUFF}$, the power transistor 924 provides the output voltage, VOUT to the load 902 that varies as a function of the buffer voltage signal, $V_{BUFF}$ and the input voltage, VIN. The linear voltage regulator 900 is configured such that if the output voltage, VOUT rises too high relative to the reference voltage, VREF, the buffer voltage signal, $V_{BUFF}$ is adjusted to control the power transistor 120 to maintain a constant output voltage, VOUT.

As illustrated, a negative drain to source voltage, $-V_{DS}$ of the power transistor 924 is equal to the input voltage, VIN minus the output voltage, VOUT (VIN−VOUT) of the linear voltage regulator 900. Accordingly, in situations where a difference between the input voltage, VIN and the output voltage (VIN-VOUT) is greater than or equal to a threshold voltage, $V_{THRESH}$, the power transistor 924 operates in the saturation region, such that noise injected into the input voltage, VIN is filtered by the buffer 112. Accordingly, in some examples, the threshold voltage, $V_{THRESH}$ is set to a voltage level that is about equal to an overdrive voltage, $V_{OV}$ of the power transistor 224.

The noise injected into the input voltage, VIN is represented as $V_{IN_AC}$. Noise at the output voltage, VOUT is represented as VOUT_AC. If the power transistor 924 operates in the saturation region, then VOUT_AC is at least one order of magnitude (1/10) less than $V_{IN_AC}$. For instance, if the threshold voltage, $V_{THRESH}$ is equal to 1 V, and the voltage, VOUT is at least 1 V less than the input voltage, VIN the power transistor 924 operates in the saturation region and filters noise, $V_{IN_AC}$ present in the input voltage, VIN. Also, if the power transistor 224 operates in the saturation region, both the first PFET 954 and the second PFET 958 also operate in the saturation region, which reduces the PSRR signal, $V_{PSRR}$ (including a noise component $V_{PSRR}$_AC) a the output node 246 of the dropout detection module 940 to a level that is about 0 volts. That is, during these intervals where the first PFET 954 and the second PFET 958 are operating in the saturation region, the PSRR signal, $V_{PSRR}$ is de-asserted.

However, in situations where VOUT−VIN ($-V_{DS}$ of the power transistor 924) approaches the threshold voltage, $V_{THRESH}$, the power transistor 924 and the first PFET 954 of the dropout detection module 940 transitions from operating in the saturation region to the linear region, such as in response to an increase in the load current, $I_{LOAD}$. As noted, the first PFET 954 is a scaled-down version of the power transistor 924, and the gate of the first PFET 954 is coupled to the gate of the power transistor 924. Thus, as the power transistor 924 transitions from the saturation region to the linear region, the first PFET 954 also transitions from the saturation region to the linear region. Due to the delta voltage, ΔV causing the gate of the second PFET 958 to be ΔV lower than the gate of the first PFET 954, as the first PFET 954 transitions from the saturation region to the linear region, the second PFET 958 remains in the saturation region. Accordingly, voltage at the output node 946 of the dropout detection module 940 increases as the first PFET 954 transitions from the saturation region to the linear region. Thus, the PSRR signal, $V_{PSRR}$ is asserted at the output node 946 of the dropout detection module 940. Accordingly, the second PFET 958 and the first PFET 954 of the dropout detection module 940 operate in concert to sense the buffer voltage signal, $V_{BUFF}$ and asserts the PSRR signal, $V_{PSRR}$ (that includes the noise component, $V_{PSRR}$_AC) if a voltage difference between a voltage level of the input voltage, VIN and a voltage level at the voltage output, VOUT is less the than the threshold voltage, $V_{THRESH}$ causing the power transistor 924 to transition to the linear region. In this situation, the noise of the PSRR signal, $V_{PSRR}$_AC is an amplified version of the noise at the input voltage, $V_{IN_AC}$. Stated differently, the dropout detection module 940 asserts the PSRR signal, $V_{PSRR}$ if VIN−VOUT<$V_{THRESH}$. Further, the dropout detection module 940 de-asserts the PSRR signal, $V_{PSRR}$ if the voltage difference between the voltage level of the voltage input voltage, VIN and the voltage level at the voltage output, VOUT is greater than or equal to the threshold voltage, $V_{THRESH}$, indicating that the power transistor 924 is transitioning to the saturation region.

The feedforward module 920 receives the PSRR signal, $V_{PSRR}$ and the power supply rejection ratio capacitor 988 blocks the direct current (DC) portion of the PSRR signal, $V_{PSRR}$, such that the noise component of the PSRR signal, $V_{PSRR}$_AC is provided to the node 986 and amplified by the fourth PFET 982. The amplified version of the noise component of the PSRR signal, $V_{PSRR}$_AC is provided to the current mirror formed by the first NFET 990 and the second NFET 992 and is coupled to the output node 968 of the feedforward module 920 outputs a noise rejection signal, $V_{NOISE_REJ}$ (alternatively referred to as a feedforward signal) is an amplified and inverted version of the PSRR signal, $V_{PSRR}$_AC, which in turn is an amplified version of the noise in the input voltage, $V_{IN_AC}$. Conversely, in response to de-assertion of the PSRR signal, $V_{PSRR}$, the feedforward module 920 de-asserts the noise rejection signal, $V_{NOISE_REJ}$. In this manner, the dropout detection module 940 and the feedforward module 920 operate in concert to selectively provide a PSRR boost.

Responsive to injection of the noise rejection signal, $V_{NOISE_REJ}$, the buffer 912 and the power transistor 924 are configured to operate in concert to filter noise from the input voltage, VIN. More particularly, injection of the noise rejection signal, $V_{NOISE_REJ}$ injects an inverted version of the noise at the input voltage, $V_{IN_AC}$ into the output of the buffer 912, $V_{BUFF}$. Accordingly, the inverted version of the noise of the input voltage, $V_{IN_AC}$ is included in the signal driving the gate of the power transistor 924, such that the power transistor 924 cancels out the noise component from the input voltage, $V_{IN_AC}$ during amplification of the input voltage, VIN during operation in the linear region.

Accordingly, the dropout detection module 940 selectively activates the feedforward module 920 during time intervals where the voltage difference between the input voltage, VIN and the voltage output, VOUT is less than the threshold voltage, $V_{THRESH}$ (e.g., during time intervals where VIN-VOUT<$V_{THRESH}$). For example, the PSRR signal, $V_{PSRR}$ is asserted during time intervals where the load current, $I_{LOAD}$ increases to a level that causes the voltage difference between the input voltage, VIN and the output voltage, VOUT to be less than the threshold voltage, $V_{THRESH}$. Similarly, the feedforward module 920 is deactivated during time intervals where the voltage difference between the input voltage, VIN and the voltage output, VOUT is greater or equal to the $V_{THRESH}$ (e.g., during time intervals where VIN-VOUT $V_{THRESH}$). In this manner, the dropout voltage of the linear voltage regulator 900 and/or a size of the power transistor 924 is reducible without a reduction in power efficiency of the linear voltage regulator 900, in contrast to conventional techniques for lowering the dropout voltage.

Conventional methods to increase the PSRR of voltage regulator circuits include decreasing a power efficiency of the regulator to increase an available headroom. Instead of such conventional techniques, the linear voltage regulator 900 selectively asserts a noise rejection signal, $V_{NOISE_REJ}$ to cancel noise present in the input voltage, VIN.

Further, in contrast to the linear voltage regulator 200 of FIG. 1, the linear voltage regulator 900 employs a PFET as the power transistor 924. Using a PFET as a power transistor 924, instead of an NFET enables a single power source, namely the input voltage, VIN to power components of the linear voltage regulator 900, at a cost of increased size needed for the PFET relative to the size needed for a NFET with similar operating characteristics.

Figure 12:
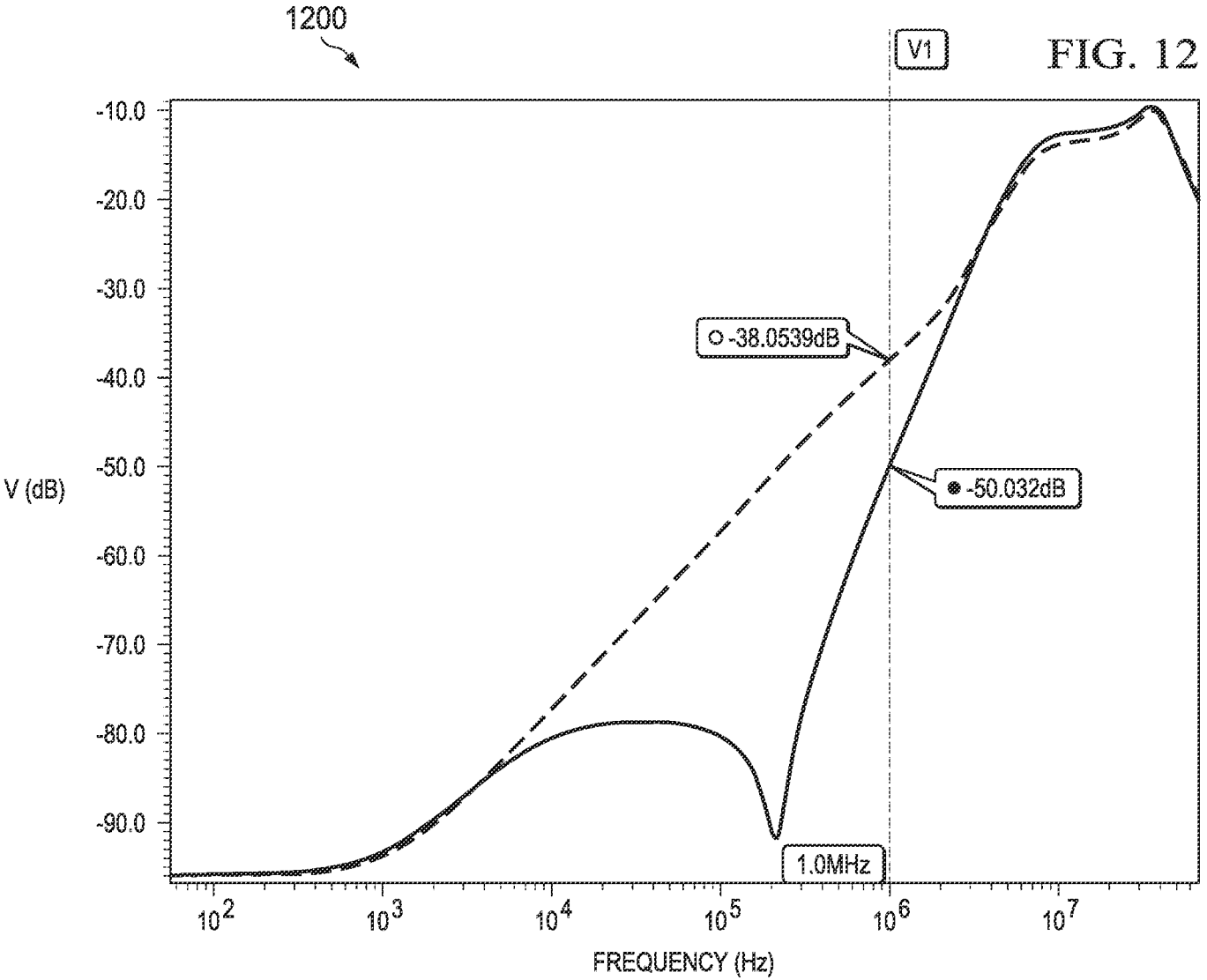
FIG. 12 is a graph plotting a voltage gain of noise as a function of frequency for the linear voltage regulator of FIG. 9.

FIG. 12 illustrates a graph 1200 that includes plots of a voltage gain, Av in decibels (dB) of noise as a function of frequency in hertz (Hz) using Equation 1. The graph 1200 includes a first plot with a PSRR boost using the linear voltage regulator 200, in which the delta voltage, ΔV is set to 120 millivolts (mV) and VIN-VOUT, which also defines $-V_{DS}$ for the power transistor 924 is 400 mV. Further, it is presumed that the load current, $I_{LOAD}$ is about 1 milliampere (mA). Also, for purposes of comparison the graph 1200 includes a second plot using a conventional voltage regulator circuit, in which the dropout detection module 940 and the feedforward module 920 of FIG. 9 have been omitted, such that the linear voltage regulator operates without a PSRR boost. Because the graph 1200 plots the gain of noise (VOUT_AC/VIN_AC), lower gain, Av (more negative) corresponds to increased performance of the linear voltage regulator.

As illustrated, the PSRR boost provided by the dropout detection module 940 and the feedforward module 920 the linear voltage regulator 200 provides increased PSRR for noise at frequencies of about 1.5 kHz to about 1.2 MHz. Accordingly, as explained above, the dropout detection module 940 selectively asserts and de-asserts the PSRR signal, $V_{PSRR}$ to avoid a loss of power efficiency.

Figure 13:
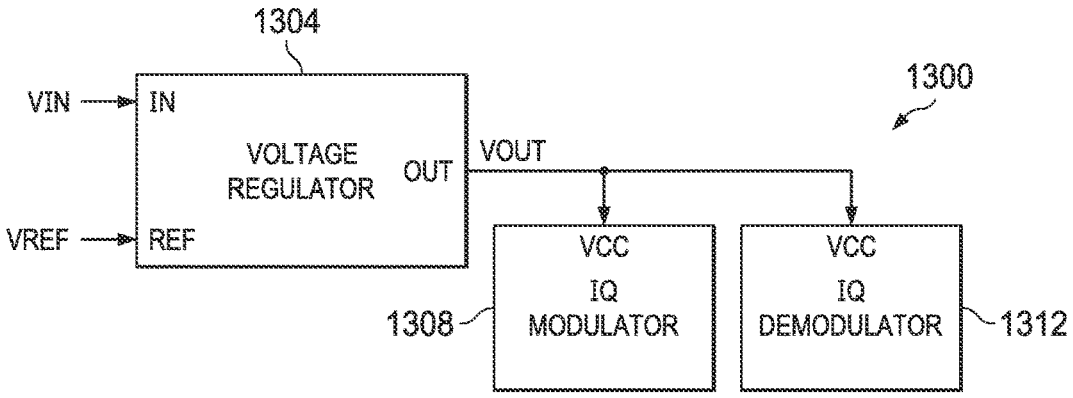
FIG. 13 illustrates a block diagram of a system that provides an example application for a linear voltage regulator.

FIG. 13 illustrates a block diagram of a system 1300 that provides an example application for a linear voltage regulator 1304. The linear voltage regulator 1304 is an LDO voltage regulator circuit and is implemented with the linear voltage regulator 100 of FIG. 1, the linear voltage regulator 200 of FIG. 2 and/or the linear voltage regulator 900 of FIG. 9. The linear voltage regulator 1304 receives an input voltage, VIN and provides an output voltage, VOUT in a manner described above. Also, the linear voltage regulator 1304 receives a reference voltage, VREF. The linear voltage regulator 1304 limits power-supply-generated phase noise and clock jitter present on the output voltage, VOUT. Accordingly, the linear voltage regulator 1304 is employable for powering high-performance serializers and deserializers (SerDes), analog-to-digital converters (ADCs), digital-to-analog converters (DACs), and radio frequency (RF) components.

As an example of such RF components, the system 1300 includes an in-phase quadrature (IQ) modulator 1308 and an IQ demodulator 1312. The IQ modulator 1308 and the IQ demodulator 1312 are provided power from the output voltage, VOUT provided by the linear voltage regulator 1304 at a positive power supply node, VCC. However, the system 1300 is only one example of such an application. There are many other applications that benefit from the use of the linear voltage regulator 1304, which limits power-supply-generated phase noise and clock jitter present on the output voltage, VOUT.

Modifications are possible in the described examples, and other examples are possible, within the scope of the claims.

What is claimed is:

1. A linear voltage regulator comprising:

a buffer having a first voltage input, a buffer input, a buffer output and a first control input;

a transistor having a second control input, a second voltage input and a first voltage output, in which the second control input is coupled to the buffer output;

a dropout detection module having a third control input, a third voltage input and second and third voltage outputs, in which the third control input is coupled to the second control input, the third voltage input is coupled to the second voltage input, and the second voltage output is coupled to the first voltage output; and a feedforward module having feedforward input and a feedforward output, in which the feedforward input is coupled to the third voltage output, and the feedforward output is coupled to the first control input.

2. The linear voltage regulator of claim 1, wherein the transistor is a power transistor, and the dropout detection module includes:

a sensing transistor having a fourth control input and a fourth voltage input, in which the fourth control input is coupled to the third control input, and the fourth voltage input is coupled to the third voltage output;

a boost transistor having a fifth control input and a fifth voltage output, in which the fifth voltage output is coupled to the third voltage output; and a delta voltage source coupled between the fourth and fifth control inputs, in which the delta voltage source is configured to provide a delta voltage between the fourth and fifth control inputs.

3. The linear voltage regulator of claim 2, wherein the dropout detection module is configured to:

provide a power supply rejection ratio signal at the third voltage output responsive to a difference between a voltage at the second voltage input and a voltage at the second voltage output being less than a threshold; and cease providing the power supply rejection ratio signal at the third voltage output responsive to the difference being greater than or equal to the threshold.

4. The linear voltage regulator of claim 3, wherein the sensing transistor is a scaled-down version of the power transistor.

5. The linear voltage regulator of claim 3, wherein the feedforward module is configured to provide a noise rejection signal at the feedforward output responsive to the power supply rejection ratio signal.

6. The linear voltage regulator of claim 3, wherein the threshold is a voltage at which the power transistor transitions from a saturation region of operation to a linear region of operation.

7. The linear voltage regulator of claim 6, wherein the power transistor, the sensing transistor and the boost transistor are n-channel field effect transistors (NFETs).

8. The linear voltage regulator of claim 1, wherein the transistor is a p-channel field effect transistor (PFET).

9. A linear voltage regulator comprising:

a buffer configured to provide a buffer voltage signal;

a transistor configured to provide an output voltage based on an input voltage and the buffer voltage signal;

a dropout detection module configured to: provide a power supply rejection ratio signal responsive to a difference between the input voltage and the output voltage being less than a threshold; and cease providing the power supply rejection ratio signal responsive to the difference being greater than or equal to the threshold; and a feedforward circuit module configured to:

provide a noise rejection signal responsive to the power supply rejection ratio signal; and cease providing the noise rejection signal responsive to absence of the power supply rejection ratio signal, in which the buffer is configured to add noise in the buffer voltage signal responsive to the noise rejection signal, and the transistor is configured to filter noise from the input voltage responsive to the added noise in the buffer voltage signal.

10. The linear voltage regulator of claim 9, wherein the threshold is a voltage at which the transistor transitions from a saturation region of operation to a linear region of operation.

11. The linear voltage regulator of claim 10, wherein the transistor is a power transistor having a first channel size, the dropout detection module includes a sensing transistor having a second a channel size, and the first channel size is at least three orders of magnitude greater than the second channel size.

12. The linear voltage regulator of claim 11, wherein: the dropout detection module includes a boost transistor; and the power transistor, the sensing transistor and the boost transistor are n-channel field effect transistors (NFETs).

13. The linear voltage regulator of claim 11, wherein the buffer is configured to provide the buffer voltage signal based on the input voltage.

14. The linear voltage regulator of claim 13, wherein: the dropout detection module includes a boost transistor; and the power transistor, the sensing transistor and the boost transistor are p-channel field effect transistors (PFETs).

15. A system comprising:

a linear voltage regulator comprising:

a buffer configured to provide a buffer voltage signal;

a transistor configured to provide an output voltage based on an input voltage and the buffer voltage signal;

a dropout detection module configured to: provide a power supply rejection ratio signal responsive to a difference between the input voltage and the output voltage being less than a threshold; and cease providing the power supply rejection ratio signal responsive to the difference being greater than or equal to the threshold; and a feedforward circuit module configured to:

provide a noise rejection signal responsive to the power supply rejection ratio signal; and cease providing the noise rejection signal responsive to absence of the power supply rejection ratio signal, in which the buffer and the transistor are configured to filter noise from the input voltage responsive to the noise rejection signal; and a load coupled to an output of the linear voltage regulator, in which: the linear voltage regulator is configured to provide a current to the load and a voltage to the load; and the current varies as a function of time while the voltage remains constant.

16. The system of claim 15, wherein the dropout detection module is configured to provide the power supply rejection ratio signal during time intervals in which the current increases to a level that causes the difference between the input voltage and the output voltage to be less than the threshold.

17. The system of claim 15, wherein the transistor is a first NFET, the dropout detection module includes a second NFET that is a scaled-down version of the first NFET, a gate of the first NFET is coupled to a gate of the second NFET, and a source of the first NFET and a source of the second NFET are coupled to the load.

* * * * *